US009300093B2

(12) United States Patent
Omori et al.

(10) Patent No.: US 9,300,093 B2
(45) Date of Patent: Mar. 29, 2016

(54) GROUND CONNECTION FITTING AND GROUND CONNECTION DEVICE USING SAME

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Yasuo Omori, Yokkaichi (JP); Hiroki Hirai, Yokkaichi (JP); Masaaki Tabata, Yokkaichi (JP); Takamaru Amano, Yokkaichi (JP); Takashi Tsuchiya, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/346,128

(22) PCT Filed: Sep. 19, 2012

(86) PCT No.: PCT/JP2012/005954
§ 371 (c)(1),
(2) Date: Mar. 20, 2014

(87) PCT Pub. No.: WO2013/042354
PCT Pub. Date: Mar. 28, 2013

(65) Prior Publication Data

US 2014/0235078 A1 Aug. 21, 2014

(30) Foreign Application Priority Data

Sep. 20, 2011 (JP) ..... 2011-205152
Nov. 10, 2011 (JP) ..... 2011-246385

(51) Int. Cl.
*H01R 13/648* (2006.01)
*H01R 4/64* (2006.01)
(Continued)

(52) U.S. Cl.
CPC ..... *H01R 13/648* (2013.01); *H01R 4/64* (2013.01); *H01R 11/32* (2013.01); *H01R 4/185* (2013.01); *H01R 4/34* (2013.01); *H01R 2201/26* (2013.01)

(58) Field of Classification Search
USPC ..... 439/98, 92, 287, 883, 907
See application file for complete search history.

(56) References Cited

U.S. PATENT DOCUMENTS 5,759,055 A * 6/1998 Colantuano et al. ..... 439/287
5,934,923 A * 8/1999 Matsuoka et al. ..... 439/287
(Continued)

FOREIGN PATENT DOCUMENTS

JP 08-250165 9/1996
JP 10-208815 7/1998
JP 2011-103192 5/2011

OTHER PUBLICATIONS

International Search Report of Nov. 30, 2012.
(Continued)

*Primary Examiner* — Alexander Gilman
(74) *Attorney, Agent, or Firm* — Gerald E. Hespos; Michael J. Porco; Matthew T. Hespos

(57) ABSTRACT

It is aimed to provide a ground connection fitting capable of enhancing the reliability of connection of a ground wire to ground sections and a ground connection device using the same. A first ground connection fitting (1) connects a ground wire (E1) to a first bolt (B1) and a second bolt (B2), which a plurality of ground sections provided on a wall surface of a vehicle. The first ground connection fitting (1) includes a wire connecting portion formed by a wire-side terminal portion (4) to be mounted on an end of the ground wire (E1), and a ground-side terminal portion (5) formed with a first bolt connection hole (6) connectable to the first bolt (B1) and a second bolt connection hole (7) connectable to the second bolt (B2).

15 Claims, 25 Drawing Sheets

(51) Int. Cl.

| | |
|---|---|
| ***H01R 11/32*** | (2006.01) |
| *H01R 4/18* | (2006.01) |
| *H01R 4/34* | (2006.01) |

(56) References Cited

U.S. PATENT DOCUMENTS

| | | | | |
|---|---|---|---|---|
| 6,086,399 | A * | 7/2000 | Matsunaga et al. | 439/287 |
| 6,530,795 | B2 * | 3/2003 | Maeda et al. | 439/287 |
| 6,786,751 | B2 * | 9/2004 | Maeda et al. | 439/287 |
| 7,384,281 | B2 * | 6/2008 | Matsuoka et al. | 439/92 |
| 8,100,730 | B2 | 1/2012 | Hara et al. | |
| 8,105,103 | B2 * | 1/2012 | Nishio et al. | 439/287 |
| 8,105,121 | B2 * | 1/2012 | Miyamoto et al. | 439/883 |
| 8,137,116 | B2 * | 3/2012 | Omori et al. | 439/92 |
| D673,913 | S * | 1/2013 | Kajiura et al. | D13/147 |
| 8,747,139 | B2 * | 6/2014 | Amano | 439/287 |
| D710,806 | S * | 8/2014 | Tsukamoto | D13/147 |
| 2011/0111640 | A1 * | 5/2011 | Hara et al. | 439/660 |

OTHER PUBLICATIONS

Article 19 Amendments of Jan. 31, 2013.

* cited by examiner

GROUND CONNECTION FITTING AND GROUND CONNECTION DEVICE USING SAME

BACKGROUND

1. Field of the Invention

The present invention relates to a technique for collectively connecting ground wires to a plurality of ground sections in a vehicle.

2. Description of the Related Art

Conventionally, to connect ground wires included in a vehicle wiring harness to a ground section of a vehicle, a ground connection terminal such as a joint connector is connected to end parts of the ground wires as disclosed in Japanese Unexamined Patent Publication No. H10-208815. The ground connection terminal is connected to the ground section provided on a vehicle body. Specifically, the ground section is formed, for example, by a bolt hole open on the vehicle body. A hole of the ground terminal is aligned with the position of this ground section and a bolt is inserted through the hole of the ground terminal and tightened into the bolt hole of the vehicle body with a predetermined tightening force using a tool such as an impact wrench, whereby the ground terminal can be connected to the ground section of the vehicle body.

However, in a connection structure as described above, a bolt tightening force for connecting the ground terminal to the ground section of the vehicle body may vary. Such a variation of the bolt tightening force causes a problem of hindering an improvement in the reliability of connection of the ground terminal.

SUMMARY OF THE INVENTION

The present invention aims to provide a ground connection fitting capable of enhancing the reliability of connection of a ground wire to ground sections and a ground connection device using the same.

The present invention is directed to a ground connection fitting for connecting at least one ground wire to a plurality of ground sections provided on a wall surface in a vehicle, including a wire connecting portion shaped to be connectable to an end of the at least one ground wire; and a ground-side terminal portion including a first ground section connection part connectable to a first ground section and a second ground section connection part connectable to a second ground section different from the first ground section and having such a relative positional relationship that the first and second ground section connection parts are simultaneously connectable to the first and second ground sections.

The present invention is also directed to a ground connection device for collectively connecting ground wires to a plurality of ground sections provided on a wall surface in a vehicle, including a first ground connection fitting with a first wire connecting portion shaped to be connectable to an end of at least one first ground wire and a first ground-side terminal portion including a first ground section connection part connectable to a first ground section and a second ground section connection part adjacent to the first ground section connection part and connectable to a second ground section different from the first ground section and having such a relative positional relationship that the first and second ground section connection parts are simultaneously connectable to the first and second ground sections; and a second ground connection fitting with a second wire connecting portion shaped to be connectable to an end of at least one second ground wire different from the first ground wire and a second ground-side terminal portion formed with a first ground section connection part connectable to the first ground section, the first ground-side terminal portion including a first coupling portion to be coupled to the second ground-side terminal portion in a state having such a positional relationship that the first ground section connection part of the first ground-side terminal portion and that of the second ground-side terminal portion are simultaneously connectable to the first ground section; and a first press-contact portion for pressing the second ground-side terminal portion into contact with the first coupling portion by pressing the second ground-side terminal portion toward the first coupling portion.

DETAILED DESCRIPTION OF THE PREFERRED EMBODIMENTS

Preferred embodiments of a ground terminal fitting of the present invention and a ground connection device using the same are described with reference to the drawings.

First Embodiment

Overall Configuration of Ground Connection Device 100

Figure 7:
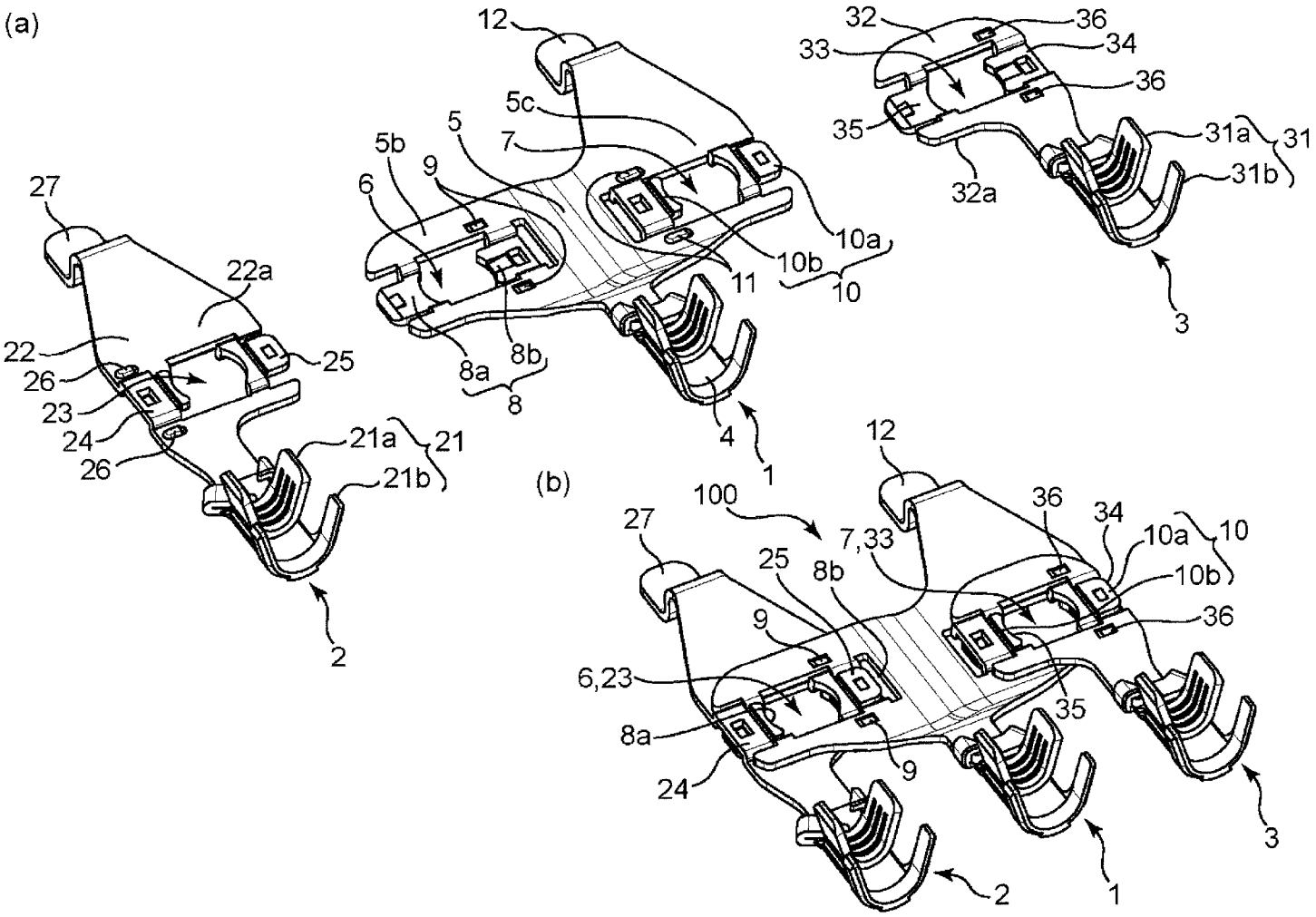
Figure 8:
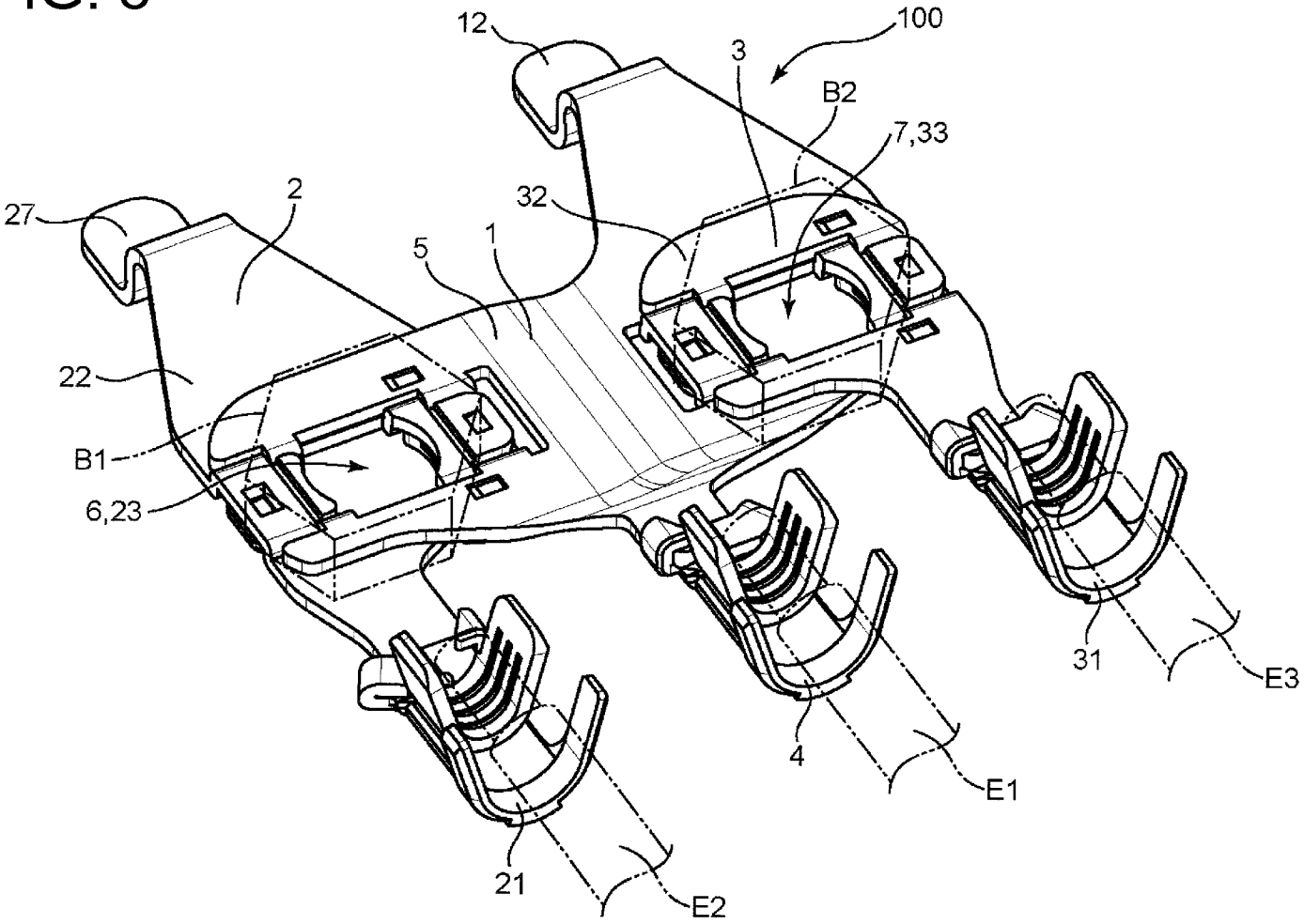
FIG. 8 is a perspective view of the ground connection device of FIG. 7(*b*) showing a state where ground wiring and bolts for ground connection are mounted.
Figure 9:
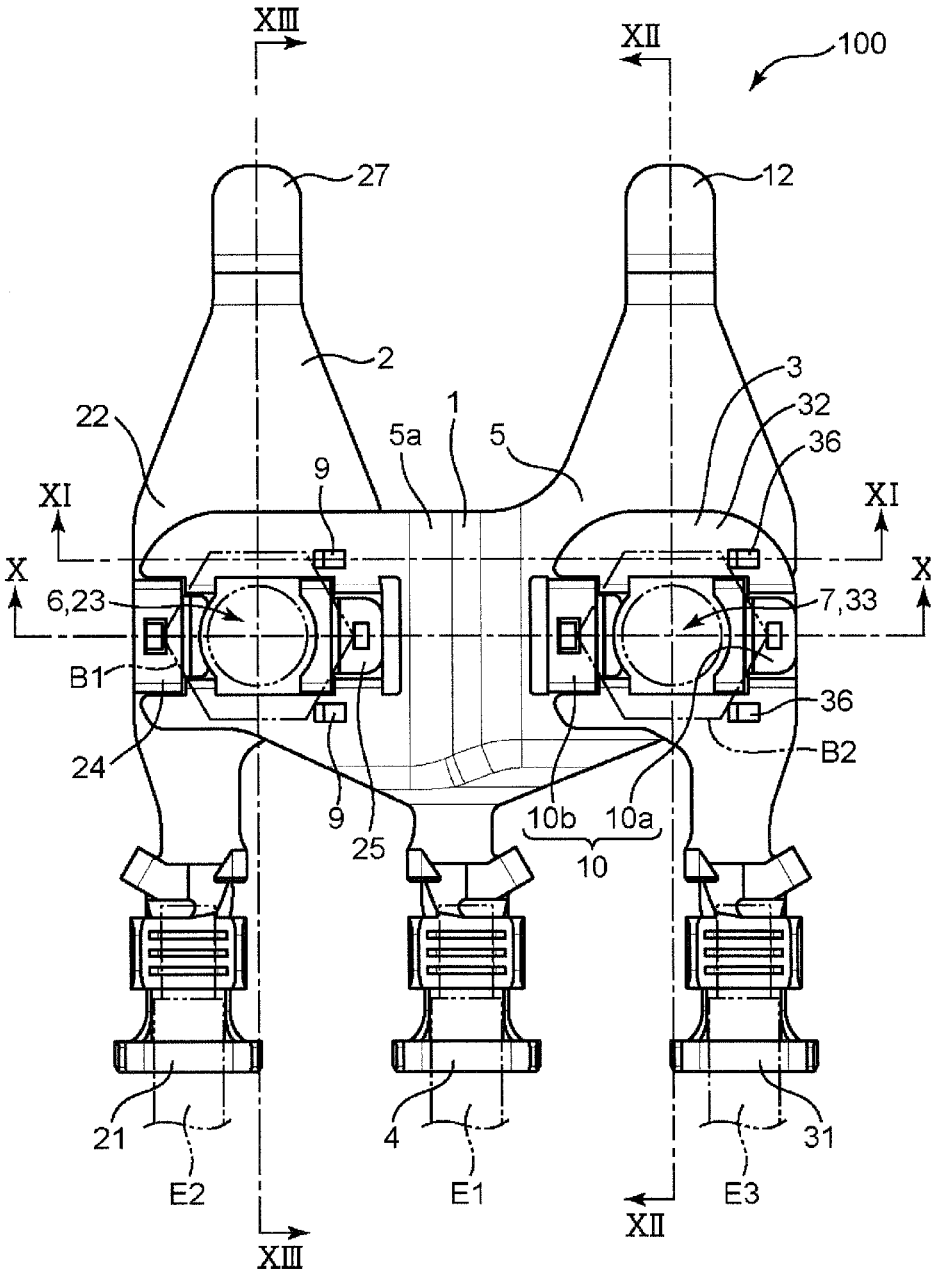
FIG. 9 is a front view of the ground connection device of FIG. 8.
Figure 10:
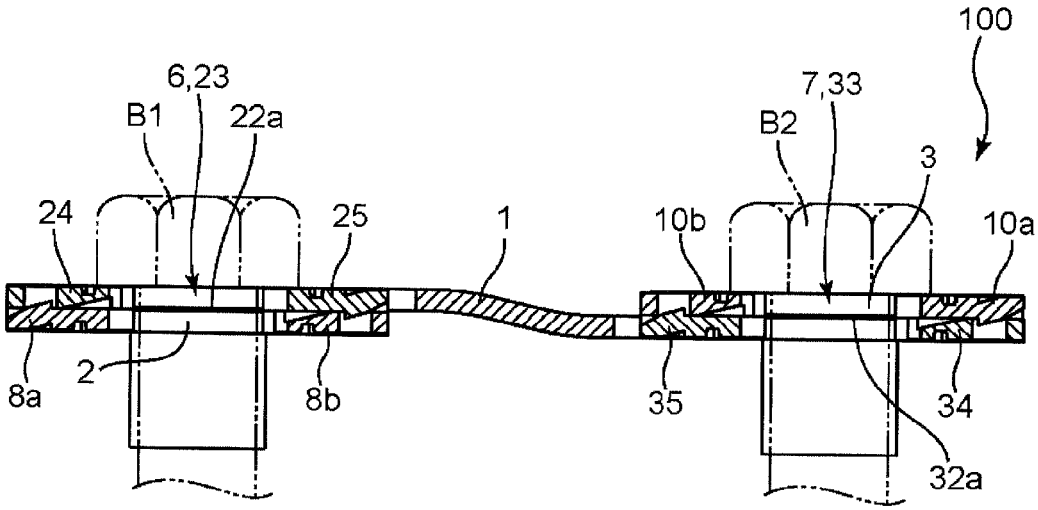
FIG. 10 is a section along X-X of FIG. 9.

As shown in FIGS. 7 to 9, a ground connection device 100 of a first embodiment includes a first ground terminal fitting 1, a second ground terminal fitting 2 and a third ground terminal fitting 3. The second and third ground terminal fittings 2, 3 are arranged on upper and lower sides of the first ground terminal fitting 1. In this ground connection device 100 of the first embodiment, the first ground terminal fitting 1 corresponds to a first ground connection fitting of the present invention, the second ground terminal fitting 2 to a second ground connection fitting of the present invention and the third ground terminal fitting 3 to a third ground connection fitting of the present invention.

A first ground wire E1, a second ground wire E2 and a third ground wire E3 are three wires respectively drawn out from specific circuits to be grounded and are each composed of a conductor and an insulation coating covering the conductor. These ground wires E1 to E3 are collectively connected to a first bolt B1 as a first ground section and a second bolt B2 as a second ground section fixed to a wall surface or the like of a vehicle via the ground connection device 100.

The first ground terminal fitting 1 connects the first ground wire E1 to the first and second bolts B1, B2, which are two ground sections.

The second ground terminal fitting 2 connects the second ground wire E2 to the first bolt B1 and also to the second bolt B2 via the first ground terminal fitting 1.

The third ground terminal fitting 3 connects the third ground wire E3 to the second bolt B2 and also to the first bolt B1 via the first ground terminal fitting 1.

Next, the configuration of each of the first to third ground terminal fittings 1, 2 and 3 is described in more detail.

(Configuration of First Ground Terminal Fitting 1)

As shown in FIGS. 1 to 6, the first ground terminal fitting 1 is a ground terminal fitting for connecting the first ground wire E1 to the first and second bolts B1, B2, which are a plurality of ground sections provided on the wall surface in the vehicle. The first ground terminal fitting 1 corresponds to a ground connection fitting formed by the ground terminal fitting of the present invention.

The first ground terminal fitting 1 includes a first wire-side terminal portion 4 and a first ground-side terminal portion 5. The first ground terminal fitting 1 is manufactured of a conductive material. The first wire-side terminal portion 4 corresponds to a first wire connecting portion of the present invention.

The first wire-side terminal portion 4 is mounted on an end of the first ground wire E1. The first wire-side terminal portion 4 includes a conductor barrel 4*a* and an insulation barrel 4*b*. The conductor barrel 4*a* is formed by a strip-like part open on both ends and can embrace and fix a part of the end of the first ground wire E1 where the conductor is exposed. The insulation barrel 4*b* is arranged in parallel with the conductor barrel 4*a* and formed by a strip-like part open on both ends. The insulation barrel 4*b* can embrace and fix a part of the end of the first ground wire E1 covered by the insulation coating without exposing the conductor.

The first ground-side terminal portion 5 is in the form of a flat plate including a step portion 5*a* and has a size capable of covering bolt holes which are formed on the wall surface of the vehicle and with which the first and second bolts B1, B2 are respectively threadably engaged. The first ground-side terminal portion 5 is formed with first and second bolt connection holes 6, 7 at positions corresponding to the arrangement of the bolt holes with which the first and second bolts B1, B2 are respectively threadably engaged. The first bolt connection hole 6 is a connection part connectable to the first bolt B1. The second bolt connection hole 7 is a connection part connectable to the second bolt B2. The first and second bolt connection holes 6, 7 are in such a relative positional relationship as to be simultaneously connectable to the first and second bolts B1, B2.

The step portion 5*a* is formed between the first and second bolt connection holes 6, 7. A first part 5*b* of the first ground-side terminal portion 5 where the first bolt connection hole 6 is formed is higher than a second part 5*c* where the second bolt connection hole 7 is formed, and the first and second parts 5*b*, 5*c* are coupled by the step portion 5*a*.

Figure 11:
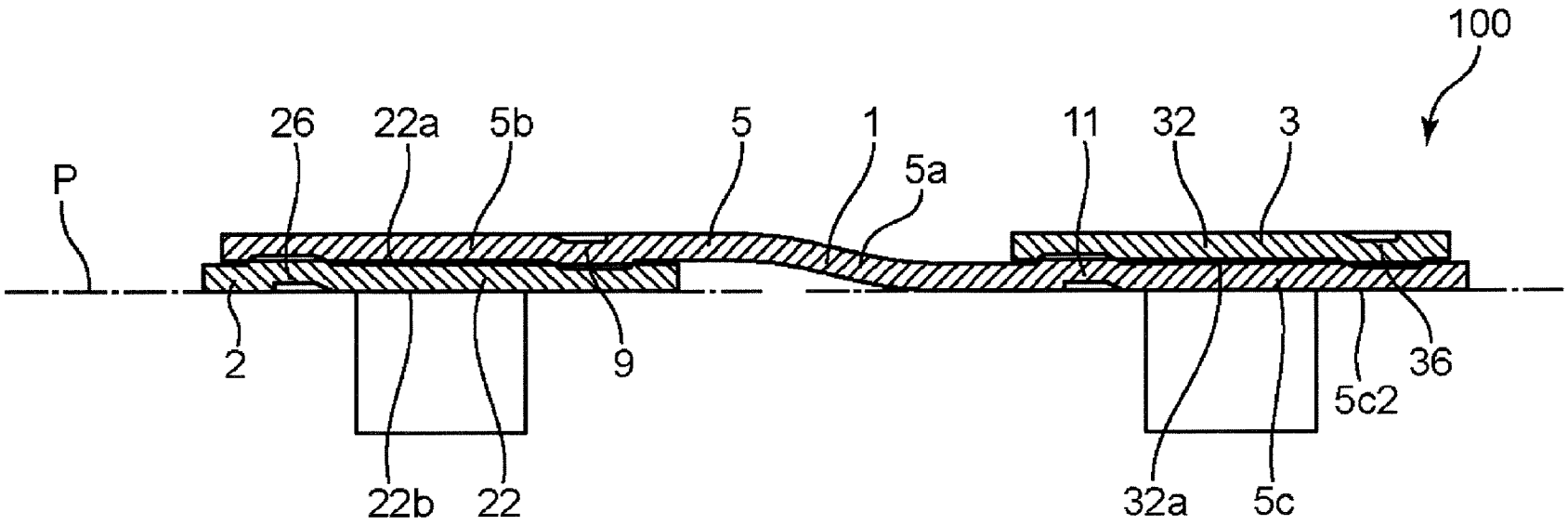
FIG. 11 is a section along XI-XI of FIG. 9.
Figure 12:
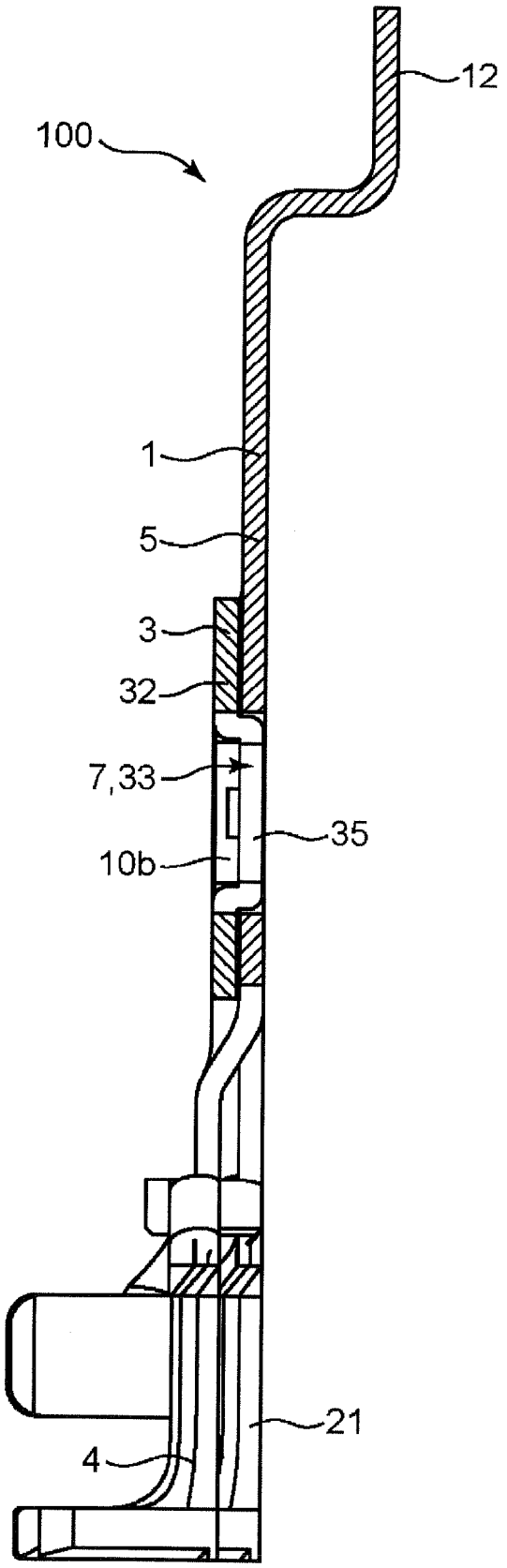
FIG. 12 is a section along XII-XII of FIG. 9.
Figure 13:
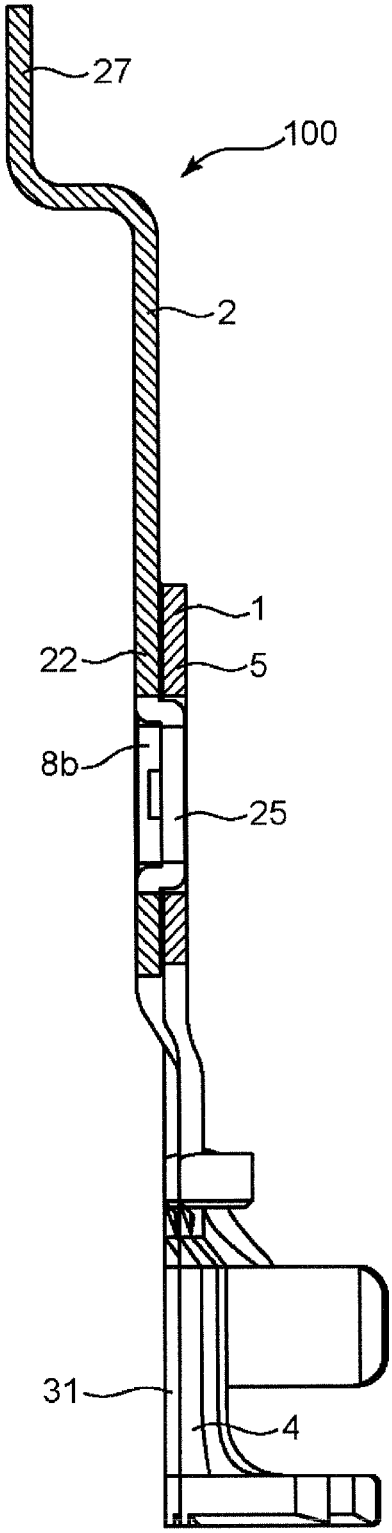
FIG. 13 is a section along XIII-XIII of FIG. 9.

Since the first ground-side terminal portion 5 includes the step portion 5*a*, a second ground-side terminal portion 22 of the second ground terminal fitting 2 can be arranged below the first part 5*b* and a third ground-side terminal portion 32 of the third ground terminal fitting 3 can be arranged above the second part 5*c* as shown in FIG. 11. A height difference between the first and second parts 5*b*, 5*c* is set at about the thickness of the second ground-side terminal portion 22.

Further, the first ground-side terminal portion 5 includes a first coupling portion 8 and first press-contact portions 9 on the first part 5*b* thereof. The first coupling portion 8 is coupled to the second ground terminal fitting 2. The first press-contact portions 9 press the ground terminal fitting 2 into contact with the first coupling portion 8.

The first coupling portion 8 is coupled to the second ground-side terminal portion 22 in such a state where the first bolt connection hole 6 of the first ground-side terminal portion 5 and a first bolt connection hole 23 (see FIG. 7(*a*)) of the second ground-side terminal portion 22 of the second ground terminal fitting 2 are aligned so as to be simultaneously connectable to the first bolt B1.

Specifically, as shown in FIGS. 1 to 3 and 6, the first coupling portion 8 includes contact pieces 8*a*, 8*b*. The contact pieces 8*a*, 8*b* are arranged at opposite sides of the first bolt connection hole 6 (opposite sides in an arrangement direction of the two connection holes 6, 7). The contact pieces 8*a*, 8*b* project in a horizontal direction away from the step portion 5*a*. Further, the contact pieces 8*a*, 8*b* are arranged at positions lower than a lower surface 5*b*1 (see FIG. 3) of the first part 5*b* of the first ground-side terminal portion 5. The contact pieces 8*a*, 8*b* can be engaged with contact pieces 24, 25 (see FIGS. 7 to 9) of the second ground-side terminal portion 22 of the second ground terminal fitting 2 to be described later.

The first press-contact portions 9 are parts projecting downward from the lower surface 5*b*1 (see FIG. 4) of the first part 5*b* of the first ground-side terminal portion 5. The first press-contact portions 9 are arranged at opposite sides (opposite sides in a direction perpendicular to the arrangement direction of the two connection holes 6, 7) of the contact piece 8*b*. The first press-contact portions 9 can press the contact pieces 24, 25 of the second ground-side terminal portion 22 into contact with the contact pieces 8*a*, 8*b* of the first coupling portion 8 by pressing the second ground-side terminal portion 22 of the second ground terminal fitting 2 to be described later toward the contact pieces 8*a*, 8*b* of the first coupling portion 8 and.

Further, the first ground-side terminal portion 5 includes a second coupling portion 10 to be coupled to the third ground terminal fitting 3 and second press-contact portions 11 for pressing the ground terminal fitting 3 into contact with the second coupling portion 10 on the second part 5*c* thereof.

The second coupling portion 10 is coupled to the third ground-side terminal portion 32 in such a state where the second bolt connection hole 7 of the second ground-side terminal portion 5 and a second bolt connection hole 33 (see FIG. 7(*a*)) of the third ground-side terminal portion 32 of the third ground terminal fitting 3 are aligned so as to be simultaneously connectable to the second bolt B2.

Specifically, as shown in FIGS. 1 to 3 and 5, the second coupling portion 10 includes contact pieces 10*a*, 10*b*. The contact pieces 10*a*, 10*b* are arranged at opposite sides of the second bolt connection hole 7 (opposite sides in the arrangement direction of the two connection holes 6, 7). The contact pieces 10*a*, 10*b* project in a horizontal direction away from the step portion 5*a* (specifically, in a direction opposite to the facing direction of the contact pieces 8*a*, 8*b*). Further, the contact pieces 10*a*, 10*b* are arranged at positions higher than an upper surface 5*c*1 (see FIG. 3) of the second part 5*c* of the first ground-side terminal portion 5. The contact pieces 10*a*, 10*b* can be engaged with contact pieces 34, 35 (see FIGS. 7 to 9) of the third ground-side terminal portion 32 of the third ground terminal fitting 3 to be described later.

The second press-contact portions 11 are parts projecting upward from the upper surface 5*c*1 (see FIG. 4) of the second part 5*c* of the first ground-side terminal portion 5. The second press-contact portions 11 are arranged at opposite sides (opposite sides in a direction perpendicular to the arrangement direction of the two connection holes 6, 7) of the contact piece 10*b*. The press-contact portions 11 can press the contact pieces 34, 35 of the third ground-side terminal portion 32 into contact with the contact pieces 10*a*, 10*b* of the second coupling portion 10 by pressing the third ground-side terminal portion 32 of the third ground terminal fitting 3 to be described later toward the contact pieces 10*a*, 10*b* of the second coupling portion 10.

Further, the second part 5*c* of the first ground-side terminal portion 5 is formed with a tongue piece 12 which is fitted into a hole formed on the wall surface at a position distant from the second bolt connection hole 7 to prevent the first ground terminal fitting 1 from rotating about the bolts B1, B2.

(Configuration of Second Ground Terminal Fitting 2)

As shown in FIGS. 7 to 13, the second ground terminal fitting 2 includes a second wire-side terminal portion 21 and a second-side terminal portion 22. The second ground terminal fitting 2 is manufactured of a conductive material. The second wire-side terminal portion 21 corresponds to a second wire connecting portion of the present invention.

The second wire-side terminal portion 21 is mounted on an end of the second ground wire E2. The second wire-side terminal portion 21 includes a conductor barrel 21*a* and an insulation barrel 21*b*. The conductor barrel 21*a* is formed by a strip-like part open on both ends and can embrace and fix a part of the end of the second ground wire E2 where the conductor is exposed. The insulation barrel 21*b* is arranged in parallel with the conductor barrel 21*a* and formed by a strip-like part open on both ends. The insulation barrel 21*b* can embrace and fix a part of the end of the second ground wire E2 covered by the insulation coating without exposing the conductor.

The second ground-side terminal portion 22 is in the form of a flat plate and has a size capable of covering the bolt hole which is formed on the wall surface of the vehicle and with which the first bolt B1 is threadably engaged. The second ground-side terminal portion 22 is formed with the first bolt connection hole 23, which is a connection part connectable to the first bolt B1.

Further, the second ground-side terminal portion 22 includes the contact pieces 24, 25 to be respectively engaged with the contact pieces 8*a*, 8*b* of the first coupling portion 8 of the above first ground terminal fitting 1. The contact pieces 24, 25 are arranged at opposite sides of the first bolt connection hole 23. The contact pieces 24, project in the direction opposite to the facing direction of the contact pieces 8*a*, 8*b* of the first coupling portion 8 of the above first ground terminal fitting 1. Further, the contact pieces 24, 25 are arranged at positions higher than an upper surface 22*a* (see FIGS. 7(*a*) and 10) of the second ground-side terminal portion 22. The contact pieces 24, 25 can be engaged in contact with the upper surfaces of the contact pieces 8*a*, 8*b* of the first ground-side terminal portion 5 of the aforementioned first ground terminal fitting 1. Further, in the first embodiment, the contact pieces 8*a*, 25 include a projection and the contact pieces 24, 8*b* to be brought into contact with the contact pieces 8*a*, 25 are formed with a recess into which the projection is fittable. Thus, the second ground terminal fitting 2 is made unlikely to be separated from the first ground terminal fitting 1 by engaging these projections and recesses.

Furthermore, third press-contact portions 26 project upward from the upper surface 22*a* (see FIGS. 7(*a*) and 11) of the second ground-side terminal portion 22. The third press-contact portions 26 are arranged at opposite sides of the contact piece 24. The third press-contact portions 26 can press the contact pieces 8*a*, 8*b* of the first ground-side terminal portion 5 into contact with the contact pieces 24, 25 by pressing the first ground-side terminal portion 5 of the first ground terminal fitting 1 toward the contact pieces 24, 25.

Note that, in the first embodiment, the first press-contact portions 9 of the first ground terminal fitting 1 and the third press-contact portions 26 of the second ground terminal fitting 2 are provided to more reliably press the contact pieces 24, 25 of the second ground terminal fitting 2 into contact with the contact pieces 8*a*, 8*b* of the first ground terminal fitting 1. However, the present invention is not limited to this. If the sizes and arrangement of the first press-contact portions 9 of the first ground terminal fitting 1 are appropriately selected, it suffices to provide only the first press-contact portions 9 and the third press-contact portions 26 of the second ground terminal fitting 2 may be omitted. Alternatively, the first press-contact portions 9 may be omitted while leaving the third press-contact portions 26 of the second ground terminal fitting 2.

Further, the second ground-side terminal portion 22 is formed with a tongue piece 27 which is fitted into a hole formed on the wall surface at a position distant from the first bolt connection hole 23 to prevent the second ground terminal fitting 2 from rotating about the bolt B1.

(Configuration of Third Ground Terminal Fitting 3)

As shown in FIGS. 7 to 13, the third ground terminal fitting 3 includes a third wire-side terminal portion 31 and a third ground-side terminal portion 32. The third ground terminal fitting 3 is manufactured of a conductive material. The third wire-side terminal portion 31 corresponds to a third wire connecting portion of the present invention.

The third wire-side terminal portion 31 is mounted on an end of the third ground wire E3. The third wire-side terminal portion 31 includes a conductor barrel 31*a* and an insulation barrel 31*b*. The conductor barrel 31*a* is formed by a strip-like part open on both ends and can embrace and fix a part of the end of the third ground wire E3 where the conductor is exposed. The insulation barrel 31*b* is arranged in parallel with the conductor barrel 31*a* and formed by a strip-like part open on both ends. The insulation barrel 31*b* can embrace and fix a part of the end of the third ground wire E3 covered by the insulation coating without exposing the conductor.

The third ground-side terminal portion 32 is in the form of a flat plate and has a size capable of covering the bolt hole which is formed on the wall surface of the vehicle and with which the second bolt B2 is threadably engaged. The third ground-side terminal portion 32 is formed with the first bolt connection hole 33, which is a connection part connectable to the second bolt B2.

Further, the third ground-side terminal portion 32 includes the contact pieces 34, 35 to be respectively engaged with the contact pieces 10*a*, 10*b* of the second coupling portion 10 of the above first ground terminal fitting 1. The contact pieces 34, 35 are arranged at opposite sides of the second bolt connection hole 33. The contact pieces 34, project in a direction opposite to the facing direction of the contact pieces 10*a*, 10*b* of the second coupling portion 10 of the above first ground terminal fitting 1. Further, the contact pieces 34, 35 are arranged at positions lower than a lower surface 32*a* (see FIGS. 7(*a*) and 10) of the third ground-side terminal portion 32. The contact pieces 34, 35 can be engaged in contact with the lower surfaces of the contact pieces 10*a*, 10*b* of the first ground-side terminal portion 5 of the aforementioned first ground terminal fitting 1. Further, in the first embodiment, the contact pieces 10*a*, 35 include a projection and the contact pieces 34, 10*b* to be brought into contact with the contact pieces 10*a*, 35 are formed with a recess into which the projection is fittable. Thus, the third ground terminal fitting 3 is made unlikely to be separated from the first ground terminal fitting 1 by engaging these projections and recesses.

Furthermore, fourth press-contact portions 36 project downward from the lower surface 32*a* (see FIGS. 7(*a*) and 11) of the third ground-side terminal portion 32. The fourth press-contact portions 36 are arranged at opposite sides of the contact piece 34. The fourth press-contact portions 36 can press the contact pieces 10*a*, 10*b* of the first ground-side terminal portion 5 into contact with the contact pieces 34, 35 by pressing the first ground-side terminal portion 5 of the first ground terminal fitting 1 toward the contact pieces 34, 35.

Note that, in the first embodiment, the second press-contact portions 11 of the first ground terminal fitting 1 and the fourth press-contact portions 36 of the third ground terminal fitting 3 are provided to more reliably press the contact pieces 34, 35 of the second ground terminal fitting 2 into contact with the contact pieces 10*a*, 10*b* of the first ground terminal fitting 1. However, the present invention is not limited to this. If the sizes and arrangement of the second press-contact portions 11 of the first ground terminal fitting 1 are appropriately selected, it suffices to provide only the second press-contact portions 11 and the fourth press-contact portions 36 of the third ground terminal fitting 3 may be omitted. Alternatively, the second press-contact portions 11 may be omitted while leaving the fourth press-contact portions 36 of the third ground terminal fitting 3.

(Assembling Method of Ground Connection Device 100 of First Embodiment)

Next, an assembling method of the ground connection device 100 of the first embodiment is described with reference to FIGS. 7 to 13.

First, the first, second and third ground wires E1, E2 and E3 are respectively connected to the wire-side terminal portions 4, 21 and 31 of the first, second and third ground terminal fittings 1, 2 and 3.

Subsequently, the second ground terminal fitting 2 is coupled to the first ground terminal fitting 1. Specifically, as shown in FIGS. 7(*a*) and 7(*b*), the second ground-side terminal portion 22 of the second ground terminal fitting 2 is placed on the lower side of the higher first part 5*b* of the first ground-side terminal portion 5. Further, the second ground-side terminal portion 22 is slid relative to the first ground-side terminal portion 5 in a direction from the first bolt connection hole 6 toward the second bolt connection hole 7 so as to align the first bolt connection hole 6 of the first ground-side terminal portion 5 and the first bolt connection hole 23 of the second ground-side terminal portion 22. In this way, the contact pieces 24, 25 of the second ground-side terminal portion 22 are engaged in contact with the upper surfaces of the contact pieces 8*a*, 8*b* of the first coupling portion 8 of the first ground-side terminal portion 5.

At this time, as shown in FIGS. 9 to 11 and 13, the first press-contact portions 9 of the first ground terminal fitting 1 press the second ground-side terminal portion 22 downward and, simultaneously, the third press-contact portions 26 of the second ground terminal fitting 2 press the first ground-side terminal portion 5 upward. Thus, the contact pieces 24, 25 of the second ground terminal fitting 2 are respectively pressed into contact with the contact pieces 8*a*, 8*b* of the first ground terminal fitting 1.

Subsequently, the third ground terminal fitting 3 is coupled to the first ground terminal fitting 1. Specifically, as shown in FIGS. 7(*a*) and 7(*b*), the third ground-side terminal portion 32 of the third ground terminal fitting 3 is placed on the upper side of the lower second part 5*c* of the first ground-side terminal portion 5. Further, the third ground-side terminal portion 32 is slid relative to the first ground-side terminal portion 5 in a direction from the second bolt connection hole 7 to the first bolt connection hole 6 so as to align the second bolt connection hole 7 of the first ground-side terminal portion 5 and the second bolt connection hole 33 of the third ground-side terminal portion 32. In this way, the contact pieces 34, 35 of the third ground-side terminal portion 32 are engaged in contact with the lower surfaces 10*a*, 10*b* of the second coupling portion 10 of the first ground-side terminal portion 5.

At this time, as shown in FIGS. 9 to 12, the second press-contact portions 11 of the first ground terminal fitting 1 press the third ground-side terminal portion 32 upward and, simultaneously, the fourth press-contact portions 36 of the third ground terminal fitting 3 press the first ground-side terminal portion 5 downward. Thus, the contact pieces 34, 35 of the third ground terminal fitting 3 are respectively pressed into contact with the contact pieces 10*a*, 10*b* of the first ground terminal fitting 1.

In the assembled ground connection device 100, the lower surface 5*c*2 of the second part 5*c* of the first ground-side terminal portion 5 located below the third ground-side terminal portion 32 is at the same height as the lower surface 22*b* of the second ground-side terminal portion 22 as shown in FIG. 11. Thus, this ground connection device 100 can be stably fixed to a mounting surface P such as the wall surface of the vehicle.

Characteristics of First Embodiment (1) In the first ground terminal fitting 1 of the first embodiment, the first ground-side terminal portion 5 is formed with the first bolt connection hole 6 connectable to the first bolt B1 and the second bolt connection hole 7 connectable to the second bolt B2 so as to be connectable to the first and second bolts B1, B2. These first and second bolt connection holes 6, 7 are in such a relative positional relationship as to be simultaneously connectable to the first and second bolts B1, B2, which are a plurality of ground sections. Thus, if at least one ground section out of the first and second bolts B1, B2 is sufficiently connected, ground connection is achieved. Accordingly, the reliability of ground connection can be enhanced as compared with conventional ground terminals for connecting a single ground connection part only to a single ground section.

(2) The ground connection device 100 of the first embodiment includes the first ground terminal fitting 1 as described above. Thus, if at least one ground section out of the first and second bolts B1, B2 is sufficiently connected, ground connection is achieved and the reliability of ground connection can be enhanced.

Further, in connecting the second ground terminal fitting 2 to the first bolt B1, the second ground-side terminal portion 22 of the second ground terminal fitting 2 can be coupled to the first coupling portion 8 of the first ground-side terminal portion 5 of the first ground terminal fitting 1 in a state where the first bolt connection hole 6 of the first ground-side terminal portion 5 and the first bolt connection hole 23 of the second ground-side terminal portion 22 are aligned to have such a relative positional relationship as to be simultaneously connectable to the first bolt B1. In addition, in this coupled state, the contact pieces 24, 25 of the second ground-side terminal portion 22 can be pressed into contact with the contact pieces 8*a*, 8*b* of the first coupling portion 8 by pressing the second ground-side terminal portion 22 toward the first coupling portion 8 by the first press-contact portions 9. In this way, the second ground terminal fitting 2 can be connected and grounded to the second bolt B2 via the first ground-side terminal portion 5 of the first ground terminal fitting 1. Thus, two ground terminal fittings 1, 2 can be reliably grounded by being connected to the bolts B1, B2, which are two ground sections.

(3) Further, in the ground connection device 100 of the first embodiment, in connecting the third ground terminal fitting 3 to the second bolt B2, the second ground-side terminal portion 22 of the second ground terminal fitting 2 can be coupled to the second coupling portion 10 of the first ground-side terminal portion 5 of the first ground terminal fitting 1 in a state where the second bolt connection hole 7 of the first ground-side terminal portion 5 and the second bolt connection hole 33 of the third ground-side terminal portion 32 are aligned to have such a relative positional relationship as to be simultaneously connectable to the second bolt B2. In addition, in this coupled state, the contact pieces 34, of the third ground-side terminal portion 32 can be pressed into contact with the contact pieces 10*a*, 10*b* of the second coupling portion 10 by pressing the third ground-side terminal portion 32 toward the second coupling portion 10 by the second press-contact portions 11. In this way, the third ground terminal fitting 3 can be connected and grounded to the first bolt B1 via the first ground-side terminal portion 5 of the first ground terminal fitting 1. Thus, the first, second and third ground terminal fittings 1, 2 and 3 can be respectively reliably grounded by being connected to the bolts B1, B2, which are two ground sections.

(4) Further, in the ground connection device 100 of the first embodiment, the second ground-side terminal portion 22 is coupled to the lower side of the first ground-side terminal portion 5 and the third ground-side terminal portion 32 is coupled to the upper side of the first ground-side terminal portion 5, whereby the second and third ground-side terminal portions 22, 32 can be separately arranged on the both lower and upper sides of the first ground-side terminal portion 5. In this way, when the second and third ground-side terminal portions 22, 32 are respectively coupled to the first ground-side terminal portion 5, an operation of coupling the second and third ground-side terminal portions 22, 32 can be easily and smoothly performed without the second and third ground-side terminal portions 22, 32 interfering with each other.

(5) Further, in the ground connection device 100 of the first embodiment, the lower surface 5*c*2 of the second part 5*c* of the first ground-side terminal portion 5 located below the third ground-side terminal portion 32 is flush with the lower surface 22*b* of the second ground-side terminal portion 22, i.e. there is no level difference between the lower surface 5*c*2 and the lower surface 22*b* of the second ground-side terminal portion 22 with the second and third ground-side terminal portions 22, 32 coupled to the first ground-side terminal portion 5. Thus, when being fixed to the wall surface or the like of the vehicle, the ground connection device 100 can be stably fixed by the bolts B1, B2 for ground connection or the like with the lower surfaces of the first and second ground-side terminal portions 5, 22 respectively held in contact with the wall surface.

Modifications of First Embodiment (A) Although the first ground terminal fitting 1 is connected to the bolts B1, B2, which are two ground sections, with the second and third ground terminal fittings 2, 3 connected thereto in the first embodiment, the present invention is not limited to this. Even in the case of singly using the first ground terminal fitting 1, ground connection is achieved and the reliability of ground connection can be enhanced if at least one ground section out of the first and second bolts B1, B2 is sufficiently connected.

(B) Although the first ground terminal fitting 1 of the first embodiment and the ground connection device 100 using the same are structured to include two connection holes 6, 7 to enable connection to the first and second bolts B1, B2, which are two ground sections, the present invention is not limited to this. In the present invention, it is suffices to appropriately provide a plurality of connection holes for grounding according to the number and arrangement of a plurality of ground sections. Also in such a case, as in the first embodiment, ground connection is achieved and the reliability of ground connection can be enhanced if at least one ground section out of the first and second bolts B1, B2 is sufficiently connected.

Further, instead of forming the two connection holes 6, 7, a long hole or a slit into which the first and second bolts B1, B2, which are two ground sections, are simultaneously insertable may be formed.

(C) Further, although the second ground-side terminal portion 22 is coupled to the lower side of the first ground-side terminal portion 5 and the third ground-side terminal portion 32 is coupled to the upper side of the first ground-side terminal portion 5 in the first embodiment, the present invention is not limited to this. A structure having an opposite arrangement, i.e. a structure in which the second ground-side terminal portion 22 is coupled to the upper side of the first ground-side terminal portion 5 and the third ground-side terminal portion 32 is coupled to the lower side of the first ground-side terminal portion 5 may be adopted. Also in such a case, as in the first embodiment, the second and third ground-side terminal portions 22, 32 can be separately arranged on the upper and lower sides of the first ground-side terminal portion 5.

(D) Further, although the lower surface 5*c*2 of the second part 5*c* of the first ground-side terminal portion 5 located below the third ground-side terminal portion 32 is located at the same height as and flush with the lower surface 22*b* of the second ground-side terminal portion 22 in the first embodiment, the present invention is not limited to this. As in the above modification (B), the lower surface of the third ground-side terminal portion 32 may be set at the same height as the lower surface of the first ground-side terminal portion 5 in the case of the structure in which the second ground-side terminal portion 22 is coupled to the upper side of the first ground-side terminal portion 5 and the third ground-side terminal portion 32 is coupled to the lower side of the first ground-side terminal portion 5. Also in such a case, when being fixed to the wall surface of the vehicle or the like, the ground connection device 100 can be stably fixed by the bolts B1, B2 for ground connection or the like with the lower surfaces of the respective first and second ground-side terminal portions 5, 32 held in contact with the wall surface as in the first embodiment.

Although the above ground connection device 100 according to the first embodiment is so structured that three ground terminal fittings 1 to 3 are united as shown in FIGS. 7 to 9, i.e. the second and third ground terminal fittings 2, 3 are arranged on the upper and lower sides of the first ground terminal fitting 1, the present invention is not limited to this. Any one or all of three ground terminal fittings may be replaced by ground joint connector(s) capable of collectively connecting a plurality of ground wires to a ground section.

In each of the following second, third and fourth embodiments, any one or all of the three ground terminal fittings 1 to 3 is/are replaced by ground joint connector(s).

Second Embodiment

In a second embodiment, a ground connection device 200 may be configured by connecting a ground joint connector 201 including one hole connectable to one ground section (here, first bolt B1) to a first ground terminal fitting 1 as shown in FIGS. 14 to 20 instead of the second ground terminal fitting 2 of the ground connection device 100 of the above first embodiment.

Specifically, the ground connection device 200 shown in FIGS. 14 to 18 includes the first ground terminal fitting 1, the ground joint connector 201 (hereinafter, referred to as a joint connector 201) including one hole, and a third ground terminal fitting 3 and is so structured that the joint connector 201 and the third ground terminal fitting 3 are arranged on upper and lower sides of the first ground terminal fitting 1. In this ground connection device 200 of the second embodiment, the first ground terminal fitting 1 corresponds to the first ground connection fitting of the present invention, the joint connector 201 to the second ground connection fitting of the present invention and the third ground terminal fitting 3 to the third ground connection fitting of the present invention.

First and third ground wires E1, E3 are collectively connected to a first bolt B1 as a first ground section and a second bolt B2 as a second ground section fixed to a wall surface or the like of a vehicle via the ground connection device 200 as in the above first embodiment.

A harness main body E20 as a collection of a plurality of ground wires 231 is connected to a wire connecting portion 221 of the joint connector 201 to form one wiring harness WH. The joint connector 201 connects each ground wire 231 (see FIG. 19) of the harness main body E20 to the first bolt B1 and also to the second bolt B2 via the first ground terminal fitting 1.

Next, the configuration of the joint connector 201 of the ground connection device 200 is described. Note that the first and third ground terminal fittings 1, 3 are not described since being common to the first and third ground terminal fittings 1, 3 of the ground connection device 100 of the above first embodiment.

As shown in FIGS. 14 to 20, the joint connector 201 includes, as main constituent parts, a ground conductor 250 (see FIGS. 19 and 20) with a ground-side terminal portion 222, a connector housing 243, and wire terminals 234 (see FIGS. 19 and 20) in the connector housing 243. The wire terminals 234, wire-side terminal portions 240 (see FIGS. 19 and 20) of the ground conductor 250 and the connector housing 243 form a wire connecting portion 221 of the present invention. Further, the ground-side terminal portion 222 corresponds to a ground-side terminal portion of the present invention. That is, the joint connector 201 functionally includes the wire connecting portion 221 and the ground-side terminal portion 222.

In this embodiment, the wire-side terminal portion 240, the ground-side terminal portion 222, a step portion 242 and a coupling portion 241 are integrally joined to form one ground conductor 250.

Figure 14:
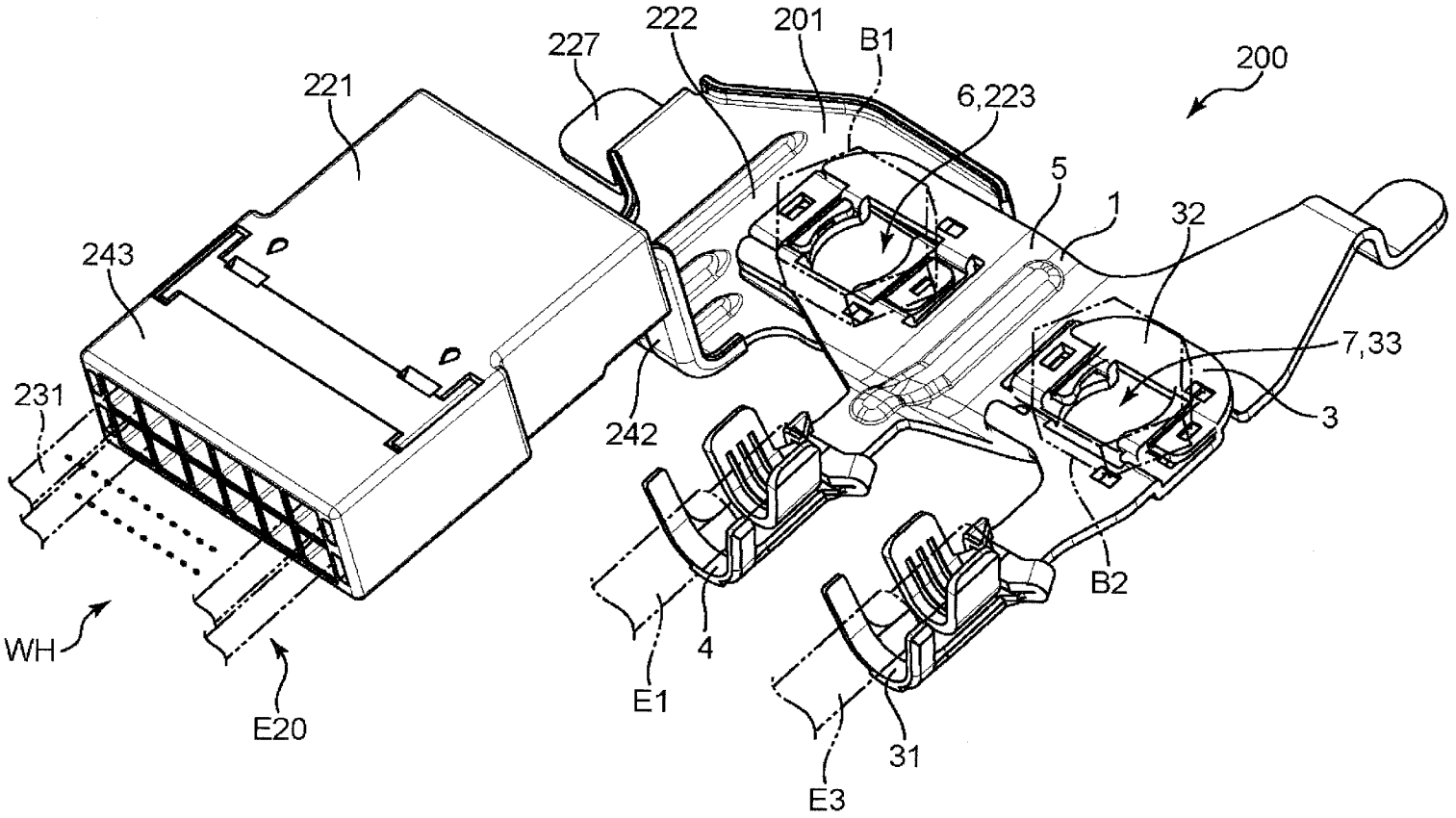
FIG. 14 is a perspective view of a ground connection device according to a second embodiment of the present invention.
Figure 15:
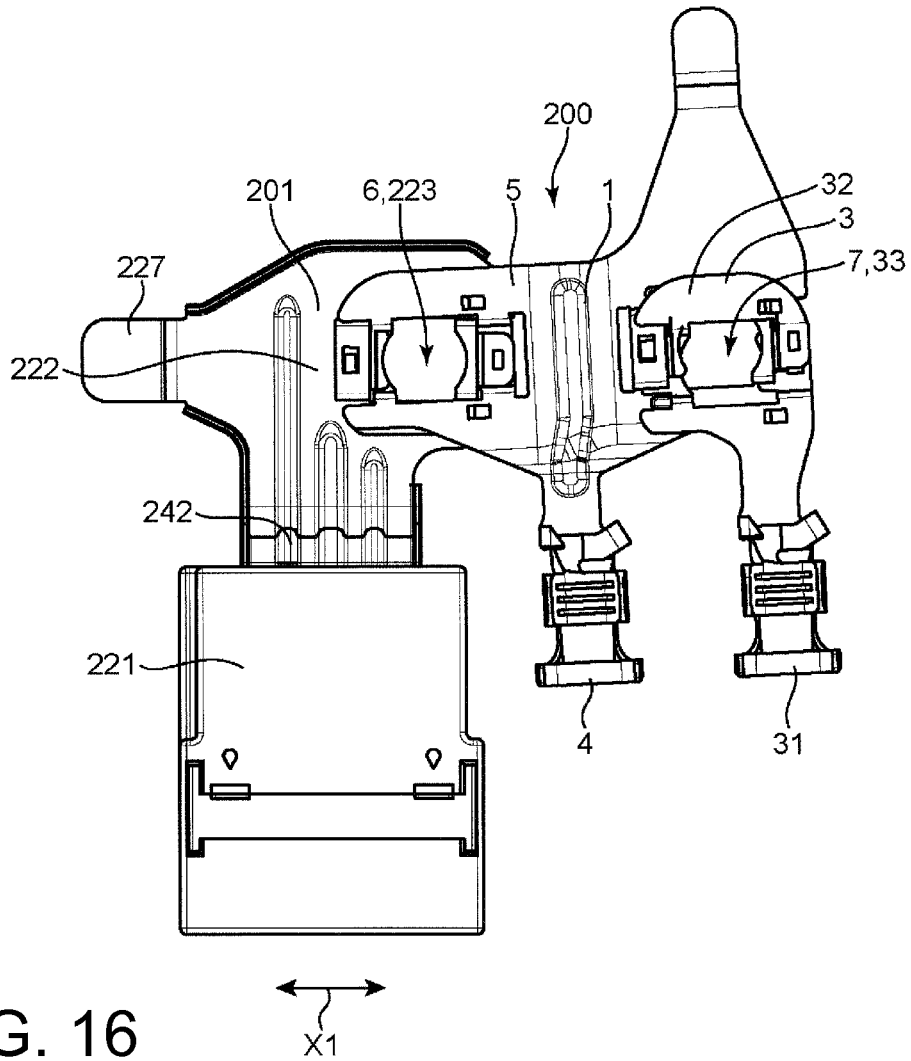
FIG. 15 is a plan view of the ground connection device of FIG. 14.
Figure 19:
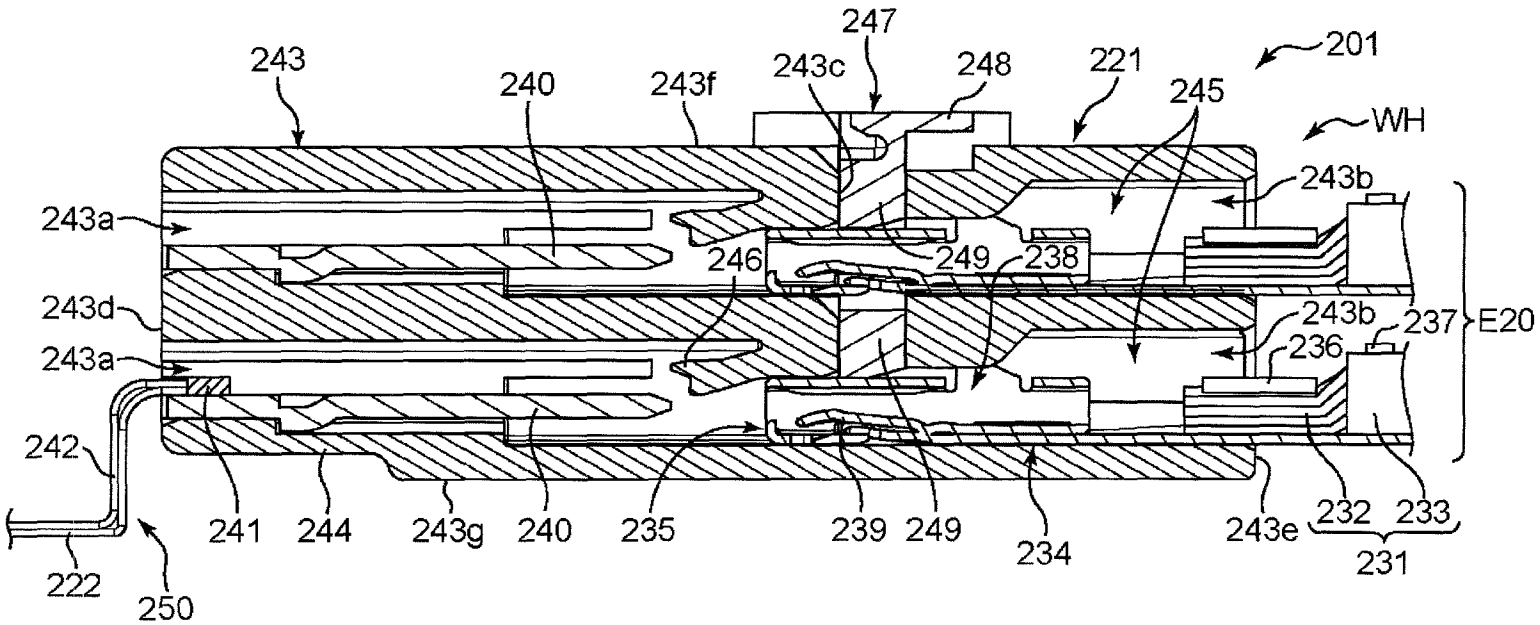
FIG. 19 is a section showing an intermediate state during the insertion of wire terminals of a joint connector of FIG. 14 into a connector housing.
Figure 20:
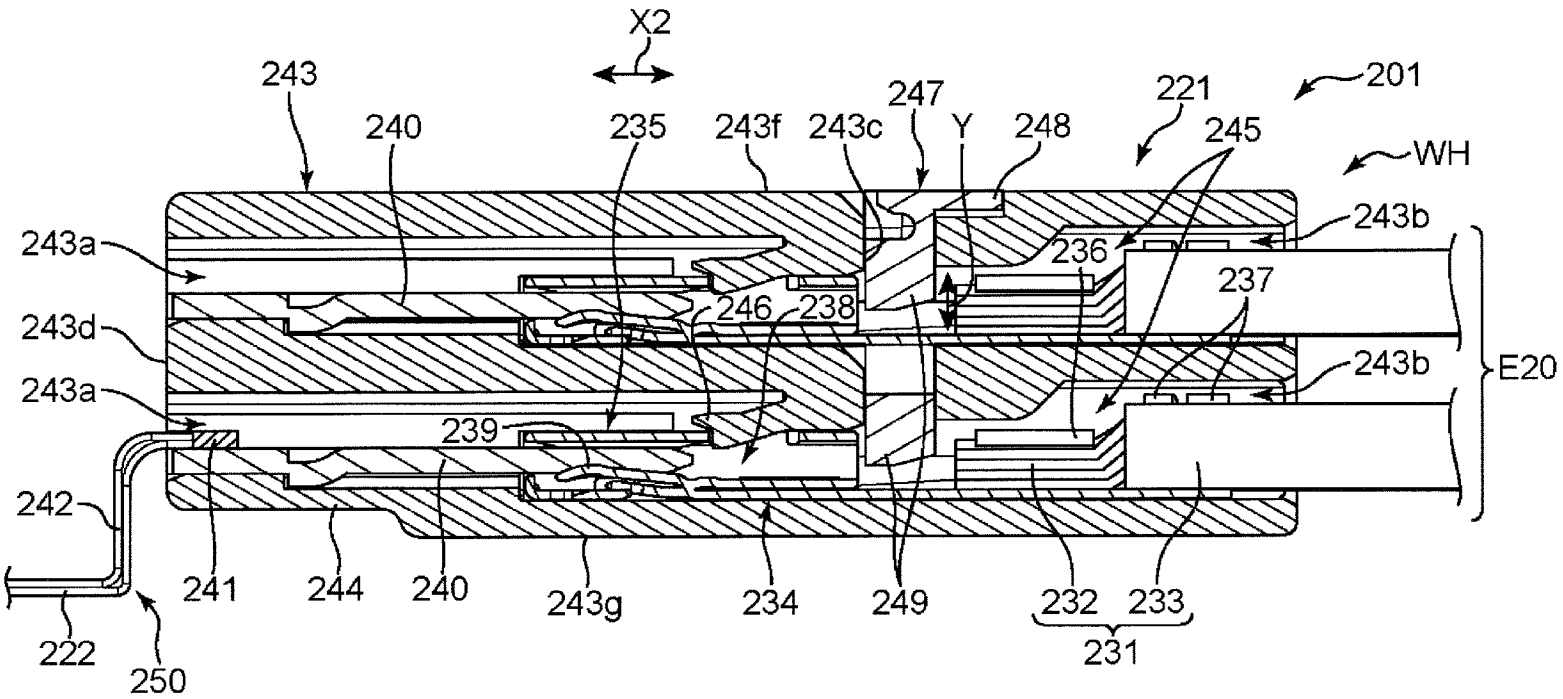
FIG. 20 is a section showing a state where the wire terminals of the joint connector of FIG. 14 are inserted in the connector housing and fixed by a retainer.

As shown in FIG. 14, the wiring harness main body E20 composed of a plurality of (twelve in a shown example) ground wires 231 is connected to the wire connecting portion 221. Each ground wire 231 is composed of a conductor 232 and an insulation coating 233 covering the conductor 232 as shown in FIGS. 19 and 20. The respective ground wires 231 are collectively connected to the first bolt B1, which is a ground section of the vehicle, via the joint connector 201 and also to the second bolt B2 via the joint connector 201 and the first ground terminal fitting 1.

The wire connecting portion 221 of this embodiment includes a plurality of wire terminals 234, the wire-side terminal portions 240 to be respectively fitted into the wire terminals 234, the connector housing 243, the step portion 242 and the coupling portion 241 as shown in FIGS. 19 and 20.

As shown in FIGS. 19 and 20, the wire terminal 234 is provided on an end of each ground wire 231 and includes a female electric contact portion 235, and a conductor barrel 236 and an insulation barrel 237 forming a wire crimping portion. These electric contact portion 235, conductor barrel 236 and insulation barrel 237 are arranged one after another in a front-back direction.

The electric contact portion 235 includes a main body in the form of a hollow rectangular tube and a contact spring piece 239 deflectably provided in this main body. A locked hole 238 for locking in the connector housing 243 is perforated in the ceiling wall of this electric contact portion 235.

The wire crimping portion is crimped to an end of the corresponding ground wire 231. The end of the ground wire 231 is processed in advance to remove the insulation coating 233 and expose the conductor 232, and the respective barrels 236, 237 of the wire crimping portion are bent to embrace an end of the conductor 232 and the insulation coating 233 near this end, thereby being crimped to the end of the ground wire 231 and electrically connected to the conductor.

A plurality of wire-side terminal portions 240 are coupled to each other by the coupling portion 241. The step portion 242 is interposed between the coupling portion 241 and the ground-side terminal portion 222. Each wire-side terminal portion 240 is connected to the common ground-side terminal portion 222 via the coupling portion 241 and the step portion 242. In this embodiment, six of the plurality of wire-side terminal portions 240 are arranged in each of two upper and lower rows. These wire-side terminal portions 240 are connected to each other by the coupling portion 241 extending substantially in a U shape over the two upper and lower rows. The coupling portion 241 is coupled to the step portion 242.

Each wire-side terminal portion 240 projects toward a back side (wire side) of the joint connector 201 and forms a male fitting portion (tab) fittable into the female electric contact portion 235 of the corresponding wire terminal 234 in a predetermined terminal fitting direction (axial direction X2 (see FIG. 20) of the ground wire 231). Each wire-side terminal portion 240 is pressed into contact with the contact spring piece 239 and the ceiling wall of the electric contact portion 235 in a state fitted in the female electric contact portion 235, thereby being electrically connected to the electric contact portion 235. These wire-side terminal portions 240 are arranged in a direction parallel to a width direction thereof (direction perpendicular to the terminal fitting direction and parallel to the wall surface) in two upper and lower rows.

The step portion 242 couples the coupling portion 241 coupling the plurality of wire-side terminal portions 240 to the ground-side terminal portion 222 in such a manner that the both are located at different heights. The step portion 242 enables electrical connection between the respective wire-side terminal portions 240 and the ground-side terminal portion 222 while providing a predetermined level difference between a lower surface 243*g* of the connector housing 243 and the ground-side terminal portion 222.

Figure 1:
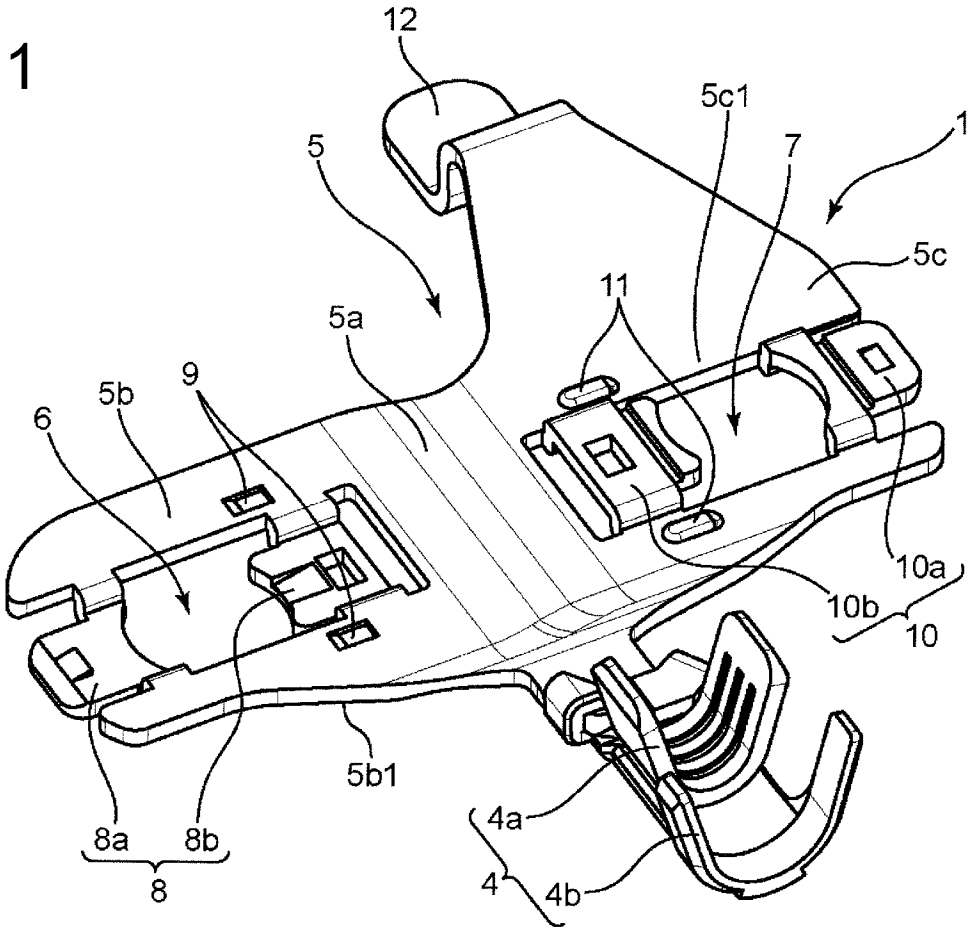
FIG. 1 is a perspective view showing the configuration of a first ground terminal fitting according to a first embodiment of the present invention.
Figure 2:
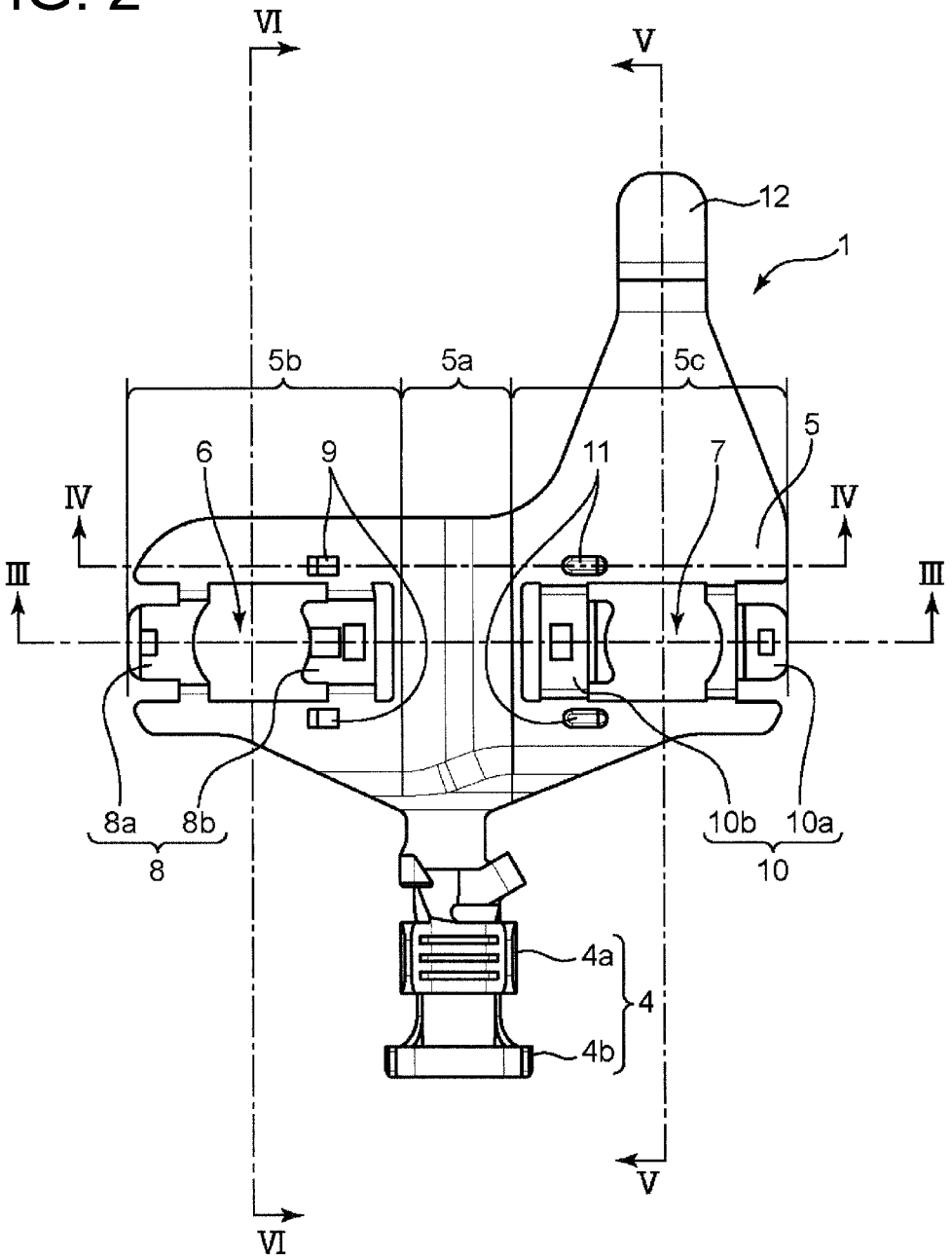
FIG. 2 is a front view of the first ground terminal fitting of FIG. 1.
Figure 3:
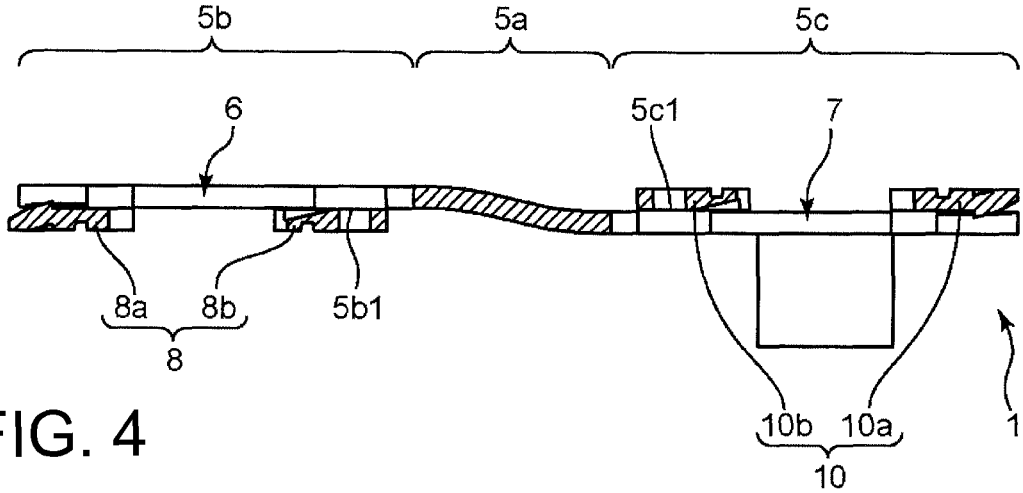
FIG. 3 is a section along III-III of FIG. 2.
Figure 4:
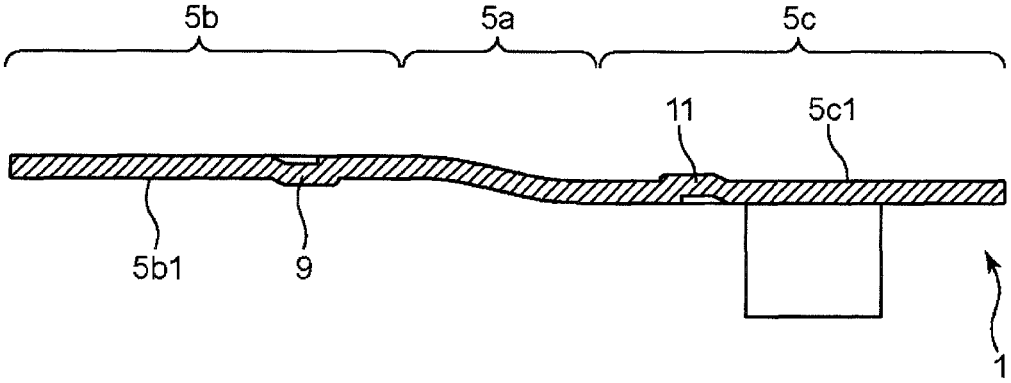
FIG. 4 is a section along IV-IV of FIG. 2.
Figure 5:
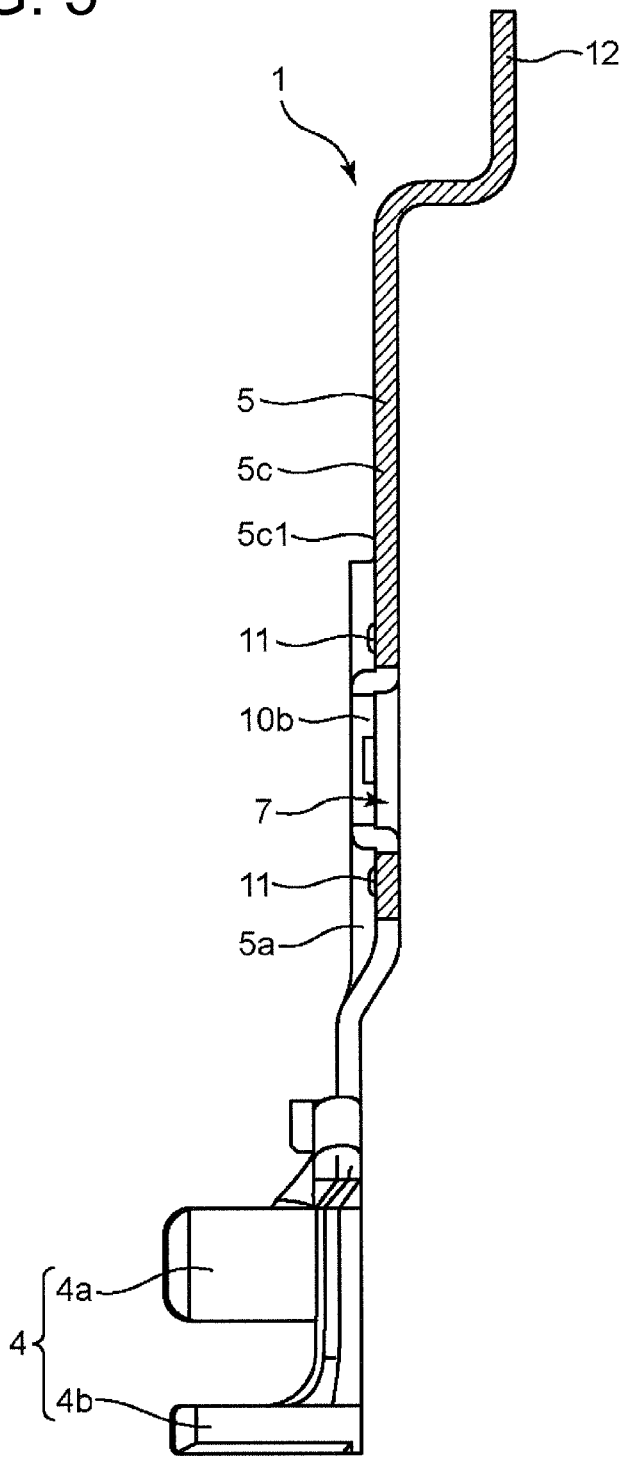
FIG. 5 is a section along V-V of FIG. 2.
Figure 6:
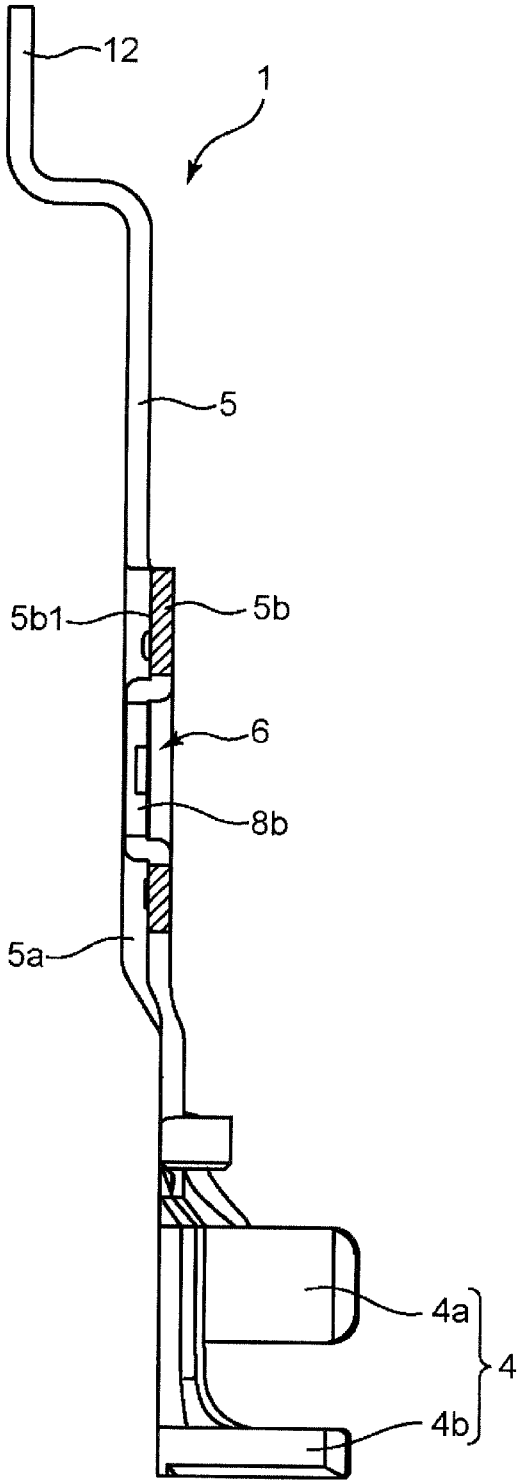
FIG. 6 is a section along VI-VI of FIG. 2, FIG. 7 are perspective views showing a ground connection device according to the first embodiment of the present invention, wherein FIG. 7(*a*) is a perspective view showing a state before three ground terminal fittings are coupled and FIG. 7(*b*) is a perspective view showing a state after the three ground terminal fittings are coupled.
Figure 16:
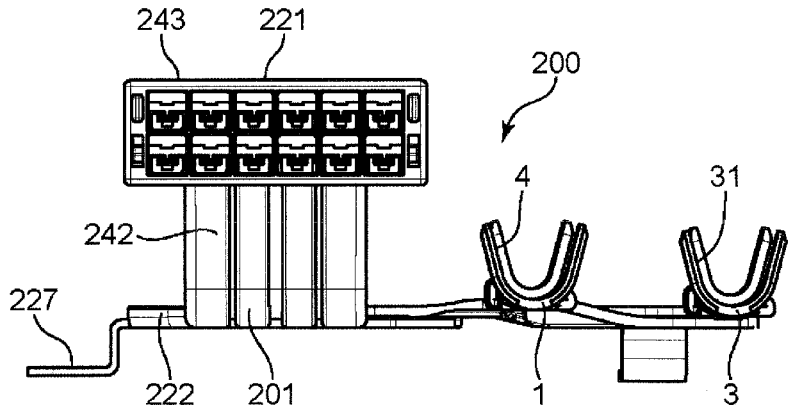
FIG. 16 is a view of the ground connection device of FIG. 14 when viewed from a side from which ground wires are connected.

Further, by providing the level difference between the wire-side terminal portions 240 and the ground-side terminal portion 222 by the step portion 242, the connector housing 243 can be arranged at a position separated from the first wire-side terminal portion 4 of the first ground terminal fitting 1 and the third wire-side terminal portion 31 of the third ground terminal fitting 3 as shown in FIGS. 1 and 16, whereby a possibility of the interference of the harness main body E20 and the ground wires E1, E3 can be reduced.

The connector housing 243 holds the ground-side terminal portion 222 in a state projecting outward while accommodating each wire-side terminal portion 240. The connector housing 243 has a flat shape in a direction perpendicular to an arrangement direction of the respective wire-side terminal portions 240. The connector housing 243 is entirely and integrally molded of an insulating material such as synthetic resin.

As shown in FIG. 19, a front surface 243*d*, a rear surface 243*e* and an upper surface 243*f* of the connector housing 243 are respectively formed with insertion openings 243*a*, 243*b* and 243*c*. Specifically, the front surface 243*d* of the connector housing 243 is formed with the ground conductor insertion holes 243*a* shaped such that a plurality of wire-side terminal portions 240 constituting the ground conductor 250 are insertable. Further, the rear surface 243*e* of the connector housing 243 is formed with the wire terminal insertion holes 243*b* shaped such that a plurality of wire terminals 234 and the wires 231 are insertable. Furthermore, the upper surface 243*f* of the connector housing 243 is formed with the retainer insertion hole 243*c* shaped such that a retainer is insertable.

This connector housing 243 includes a lower surface 243*g* facing the wall surface when the ground-side terminal portion 222 is fixed to the wall surface, and the upper surface 243*f* opposite to the lower surface 243*g*. In this embodiment, the both surfaces 243*f*, 243*g* are flat surfaces substantially parallel to the wall surface of the vehicle.

A front part (ground-side part) of the connector housing 243 forms a conductor holding portion 244. Further, a rear part (wire-side part) of the connector housing 243 includes a plurality of (twelve in the shown example) terminal accommodating chambers 245. The terminal accommodating chambers 245 communicate with the ground conductor insertion holes 243*a* and the wire terminal insertion holes 243*b*.

These terminal accommodating chambers 245 are arranged at the same interval as the wire-side terminal portions 240 in a direction parallel to the arrangement direction of the wire-side terminal portions 240. Further, the wire terminal insertion holes 243*b* are open on the rear surface 243*e* of the connector housing 243, i.e. on the side opposite to the ground-side terminal portion 222. The electric contact portions 235 of the respective wire terminals 234 are inserted into the terminal accommodating chambers 245 through these wire terminal insertion holes 243*b*.

The conductor holding portion 244 is internally formed with the ground conductor insertion holes 243*a* at a side (side of the front surface 243*d*) opposite to the terminal accommodating chambers 245. The conductor holding portion 244 is shaped to permit the respective wire-side terminal portions 240 of the ground conductor 250 to be press-fitted through the ground conductor insertion holes 243*a* and holds the press-fitted wire-side terminal portions 240. The respective wire-side terminal portions 240 project into the corresponding terminal accommodating chambers 245 and are held at positions to be fitted into the electric contact portions 235 of the wire terminals 234 inserted into the terminal accommodating chambers 245 in the inserting direction (terminal fitting direction X2).

As shown in FIGS. 19 and 20, the connector housing 243 is formed with locking lances 246, which are terminal locking portions, at positions corresponding to the respective terminal accommodating chambers 245. Each locking lance 246 projects obliquely inwardly from the ceiling (upper side surface) of the terminal accommodating chamber 245 in the terminal accommodating chamber 245 and a tip part thereof forms a free end part resiliently displaceable in a thickness direction Y of the connector housing 243. This tip part is resiliently deformed upwardly by coming into contact with the wire terminal 234 being inserted, thereby permitting the passage of the wire terminal 234. After the passage, this tip part resiliently returns to a proper position, thereby being fitted into the locked hole 238 of the wire terminal 234 to restrict the wire terminal 234 from behind as shown in FIG. 19. That is, the tip part locks (i.e. primarily locks) the wire terminal 234 at a position where the wire terminal 234 is connected to the wire-side terminal portion 240 by preventing the wire terminal 234 from being displaced in a separating direction.

The retainer 247 is for further locking (i.e. secondarily locking) each wire terminal 234 connected to the wire-side terminal portion 240 and locked by the locking lance 246 as described above, and retractably mounted into the retainer insertion hole 243*c* formed in an intermediate part of the upper surface 243*f* of the connector housing 243 in the front-back direction. Specifically, this retainer 247 is so mounted into the connector housing 243 as to be movable in the thickness direction Y of the connector housing 243 between an insertion/withdrawal permitting position (i.e. position where insertion and withdrawal are permitted) shown in FIG. 19 and a locking position retracted into the connector housing 243 from the insertion/withdrawal permitting position as shown in FIG. 20. The retainer 247 permits the insertion and withdrawal of the respective wire terminals 234 into and from the terminal accommodating chambers 245 at the insertion/withdrawal permitting position shown in FIG. 19 while being inserted into the terminal accommodating chambers 245 at the locking position shown in FIG. 20 to lock the wire terminals 234 connected to the wire-side terminal portions 240 at those positions.

As shown in FIGS. 19 and 20, the retainer 247 is formed with a ceiling wall 248 extending in a width direction (see a width direction X1 of FIG. 15) of the connector housing 243, and a plurality of locking projections 249 projecting from the lower surface of the ceiling wall 248 at positions corresponding to the respective terminal accommodating chambers 245. These locking projections 249 are retracted upward (toward the top side) from the terminal accommodating chambers 245 when the retainer 247 is at the insertion/withdrawal permitting position to permit the insertion and withdrawal of the wire terminals 234 into and from the terminal accommodating chambers 245, while projecting into the respective terminal accommodating chambers 245 to restrict the electric contact portions 235 of the wire terminals 234 from behind to doubly lock the wire terminals 234 when the retainer 247 is pushed to the locking position in a state where the wire terminals 234 are inserted in the terminal accommodating chambers 245 and locked by the locking lances 246. Note that although not shown, the retainer 247 includes locking projections or the like so as to be locked at the insertion/withdrawal permitting position and the locking position.

As shown in FIGS. 19 and 20, the wiring harness main body E20 is connected to the connector housing 243 of the joint connector 201 as follows. First, the respective wire terminals 234 mounted on the ends of the ground wires 231 of the wiring harness main body E20 are inserted into the respective terminal accommodating chambers 245 of the connector housing 243 and connected to the wire-side terminal portions 240 while passing under the locking projections 249 of the retainer 247 at the insertion/withdrawal permitting position, thereby being collectively and electrically connectable to the ground-side terminal portion 222 via the wire-side terminal portions 240, the coupling portion 241 and the step portion 242. At the time of connection, the locking lances 246, which are the terminal locking portions of the connector housing 243, are respectively fitted into the locked holes 238 provided on the electric contact portions 235 of the respective wire terminals 234 to lock (primarily lock) the electric contact portions 235, whereby the connected state of the electric contact portions 235 and the wire-side terminal portions 240 is maintained.

Subsequently, as shown in FIG. 20, the retainer 247 is pushed both in the thickness direction Y (i.e. direction Y substantially perpendicular to both the arrangement direction of the wire-side terminal portions 240 (direction parallel to the width direction X1 of FIG. 15) and the terminal fitting direction X2 (FIG. 20)) of the connector housing 243, thereby being fully locked at the locking position as shown in FIG. 20. The locking projections 249 of the retainer 247 at this locking position enter the terminal accommodating chambers 245 to restrict the electric contact portions 235 of the wire terminals 234 from behind, thereby secondarily locking the wire terminals 234. In this way, the connected state of the respective wire terminals 234 and the respective wire-side terminal portions 240 can be reliably maintained in the connector housing 243.

Figure 17:
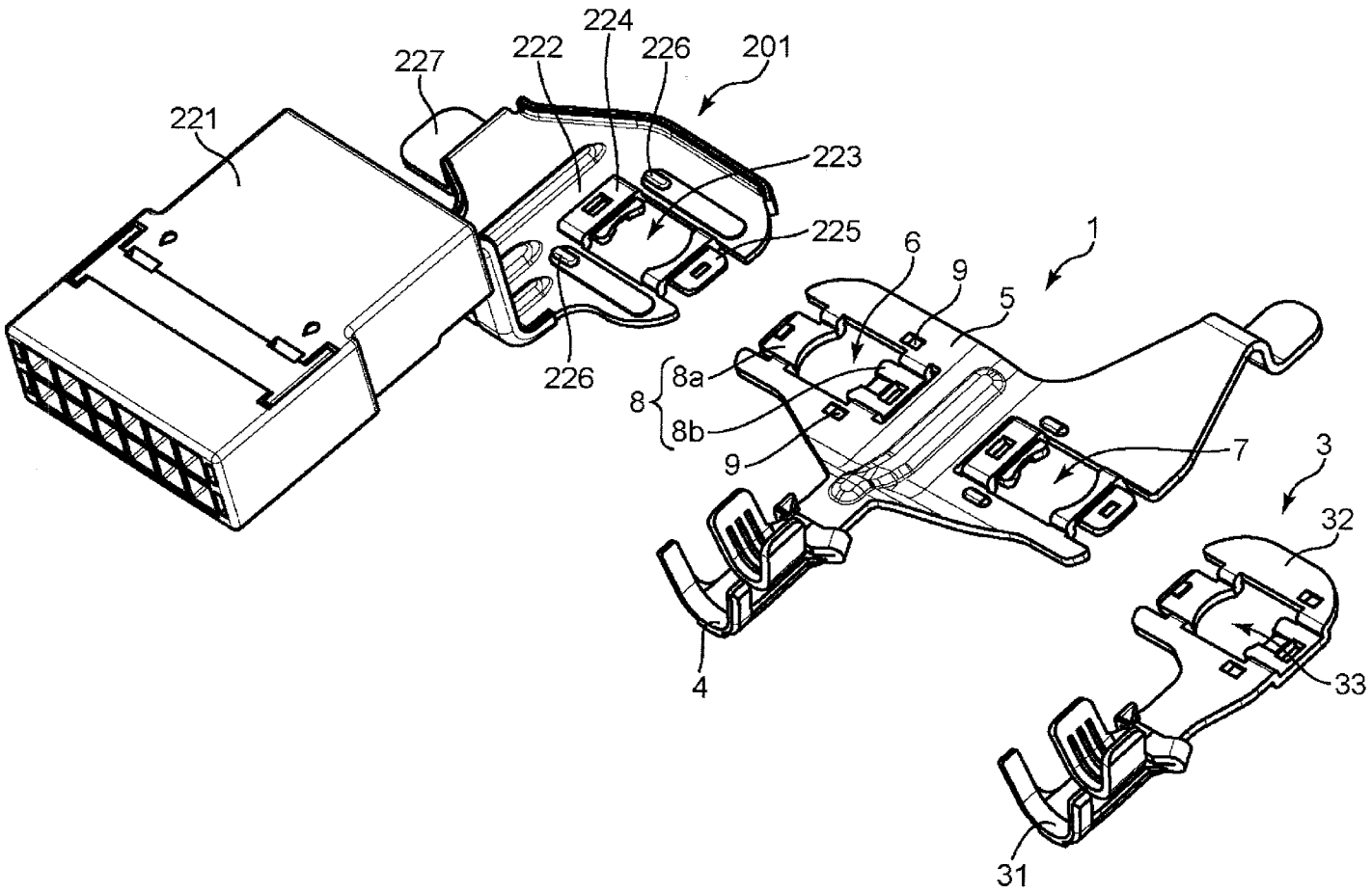
FIG. 17 is an exploded perspective view of the ground connection device of FIG. 14.
Figure 18:
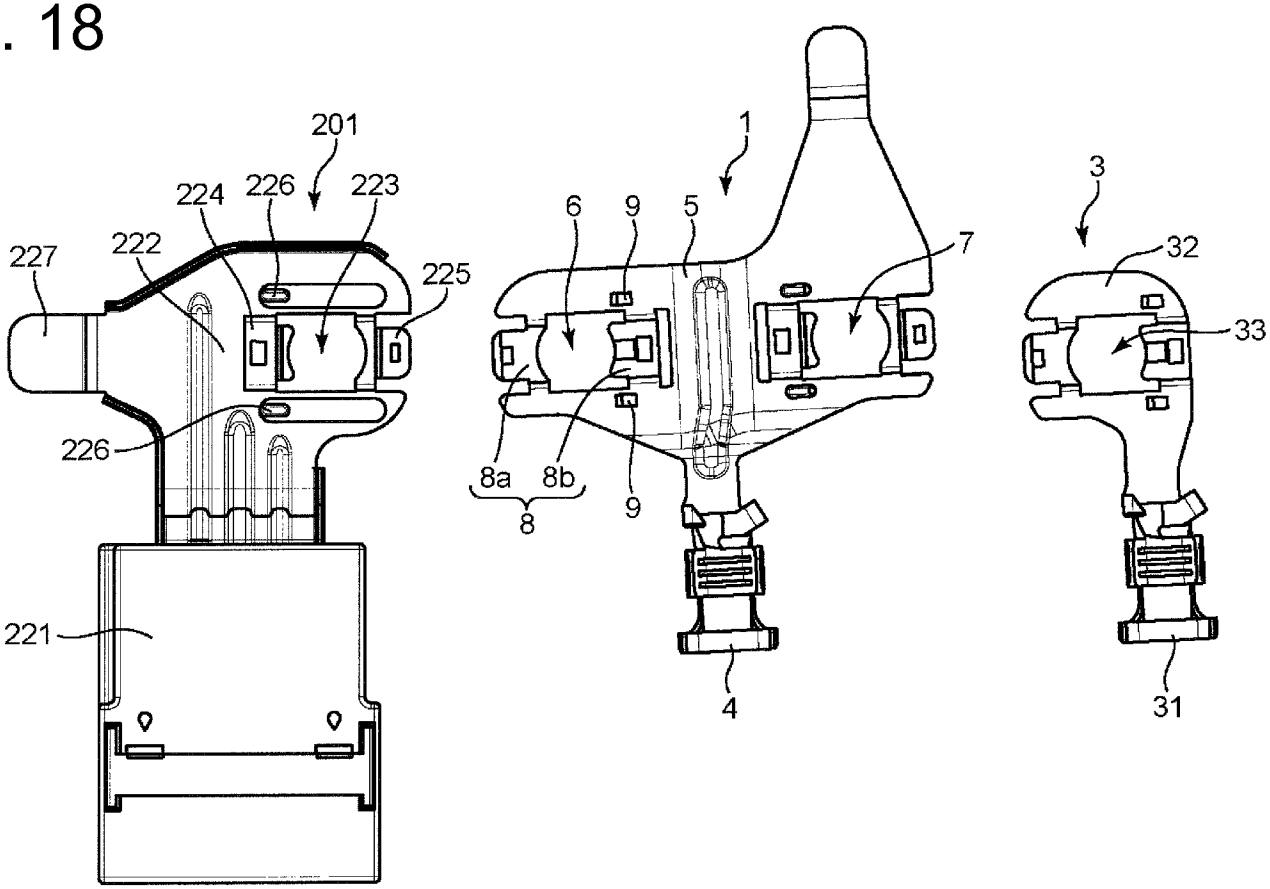
FIG. 18 is an exploded perspective view of the ground connection device of FIG. 14.

As shown in FIG. 17, the ground-side terminal portion 222 is in the form of a flat plate and has a size capable of covering the bolt hole which is formed on the wall surface of the vehicle and with which the first bolt B1 is threadably engaged. The ground-side terminal portion 222 is formed with a first bolt connection hole 223, which is a connection part connectable to the first bolt B1.

Further, the ground-side terminal portion 222 includes contact pieces 224, 225 to be respectively engaged with contact pieces 8*a*, 8*b* of a first coupling portion 8 of the first ground terminal fitting 1. The contact pieces 224, 225 are arranged at opposite sides of the first bolt connection hole 223. The contact pieces 224, 225 project in a direction opposite to a facing direction of the contact pieces 8*a*, 8*b* of the first coupling portion 8 of the above first ground terminal fitting 1. Further, the contact pieces 224, 225 are arranged at positions higher than the upper surface of the second ground-side terminal portion 222. The contact pieces 224, 225 can be engaged in contact with the upper surfaces of the contact pieces 8*a*, 8*b* of the first ground-side terminal portion of the aforementioned first ground terminal fitting 1. Further, in the second embodiment, the contact pieces 8*a*, 225 include a projection and the contact pieces 224, 8*b* to be brought into contact with the contact pieces 8*a*, 225 are formed with a recess into which the projection is fittable. Thus, the second ground terminal fitting 2 is made unlikely to be separated from the first ground terminal fitting 1 by engaging these projections and recesses.

Furthermore, press-contact portions 226 project upward from the upper surface of the second ground-side terminal portion 222. The press-contact portions 226 are arranged at opposite sides of the contact piece 224. The press-contact portions 226 can press the contact pieces 8*a*, 8*b* of the first ground-side terminal portion 5 into contact with the contact pieces 224, 225 by pressing the first ground-side terminal portion 5 of the first ground terminal fitting 1 toward the contact pieces 224, 225.

Note that, in the first embodiment, first press-contact portions 9 of the first ground terminal fitting 1 and the press-contact portions 226 of the joint connector 201 are provided to more reliably press the contact pieces 224, 225 of the joint connector 201 into contact with the contact pieces 8*a*, 8*b* of the first ground terminal fitting 1. However, the present invention is not limited to this. If the sizes and arrangement of the first press-contact portions 9 of the first ground terminal fitting 1 are appropriately selected, it suffices to provide only the first press-contact portions 9 and the press-contact portions 226 of the joint connector 201 may be omitted. Alternatively, the first press-contact portions 9 may be omitted while leaving the press-contact portions 226 of the joint connector 201.

Further, the second ground-side terminal portion 222 is formed with a tongue piece 227 which is fitted into a hole formed on the wall surface at a position distant from the first bolt connection hole 223 to prevent the joint connector 201 from rotating about the bolt B1.

Characteristics of Second Embodiment

In the ground connection device 200 of the second embodiment, the joint connector 201 is adopted as the second connection fitting to be connected to the first ground terminal fitting 1. In the wire connecting portion 221 of this joint connector 201, the plurality of wire terminals 234 mounted on the ends of the respective plurality of ground wires 231 can be fitted to the wire-side terminal portions 240 in the terminal accommodating chambers 245 of the connector housing 243. In addition, each wire-side terminal portion 240 is connected to the ground-side terminal portion 222 and the ground-side terminal portion 222 projects out from the connector housing 243. Thus, the ends of the plurality of ground wires 231 can be simultaneously connected to a plurality of ground-sides, i.e. the first and second bolts B1, B2. In addition, since variations of distances between each ground wire 231 and the first and second bolts B1, B2 as the ground sections can be suppressed low, a possibility of the occurrence of such a failure that a current flows between adjacent ground wires 231 without via the ground section can be reduced.

Third Embodiment

In a third embodiment, a ground connection device 300 may be configured by adopting a ground joint connector 301 including two holes and simultaneously connectable to two ground sections, i.e. first and second bolts B1, B2 as shown in FIGS. 21 to 26 instead of the first ground terminal fitting 1 of the ground connection device 100 of the above first embodiment and connecting the above second and third ground terminal fittings 2, 3 to the ground joint connector 301.

Specifically, the ground connection device 300 shown in FIGS. 24 to 26 includes the ground joint connector 301 (hereinafter, referred to as a joint connector 301) including two holes, a second ground terminal fitting 2 and a third ground terminal fitting 3 and is so structured that the first ground terminal fitting 2 and the third ground terminal fitting 3 are arranged on upper and lower sides of a ground-side terminal portion 305 of the joint connector 301. In this ground connection device 300 of the third embodiment, the joint connector 301 corresponds to the first ground connection fitting of the present invention, the second ground terminal fitting 2 to the second ground connection fitting of the present invention and the third ground terminal fitting 3 to the third ground connection fitting of the present invention.

A harness main body E10 as a collection of a plurality of ground wires 331 is connected to a wire connecting portion 304 of the joint connector 301 to form one wiring harness WH. The joint connector 301 can be connected to both the first bolt B1 as a first ground section fixed to a wall surface of a vehicle or the like and the second bolt B2 as a second ground section similarly to the first ground terminal fitting 1 of the above first embodiment. Thus, the plurality of ground wires 331 constituting the harness main body E10 can be collectively connected to the first and second bolts B1, B2 via the ground connection device 300.

Further, second and third ground wires E2, E3 are collectively connected to the first and second bolts B1, B2 via the ground connection device 300 as in the above first embodiment.

Next, the configuration of the joint connector 301 of the ground connection device 300 is described. Note that the second and third ground terminal fittings 2, 3 are not described since being common to the second and third ground terminal fittings 2, 3 of the ground connection device 100 of the above first embodiment.

Figure 21:
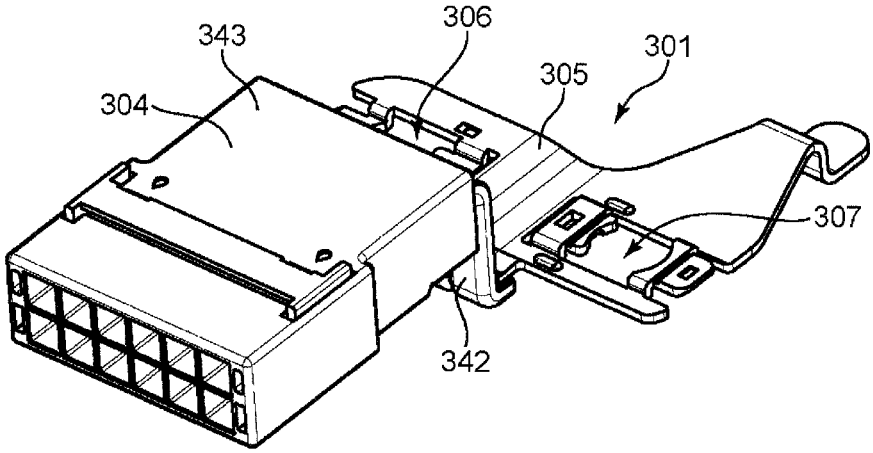
FIG. 21 is a perspective view showing the configuration of a ground joint connector corresponding to the first ground connection fitting according to a third embodiment of the present invention.
Figure 22:
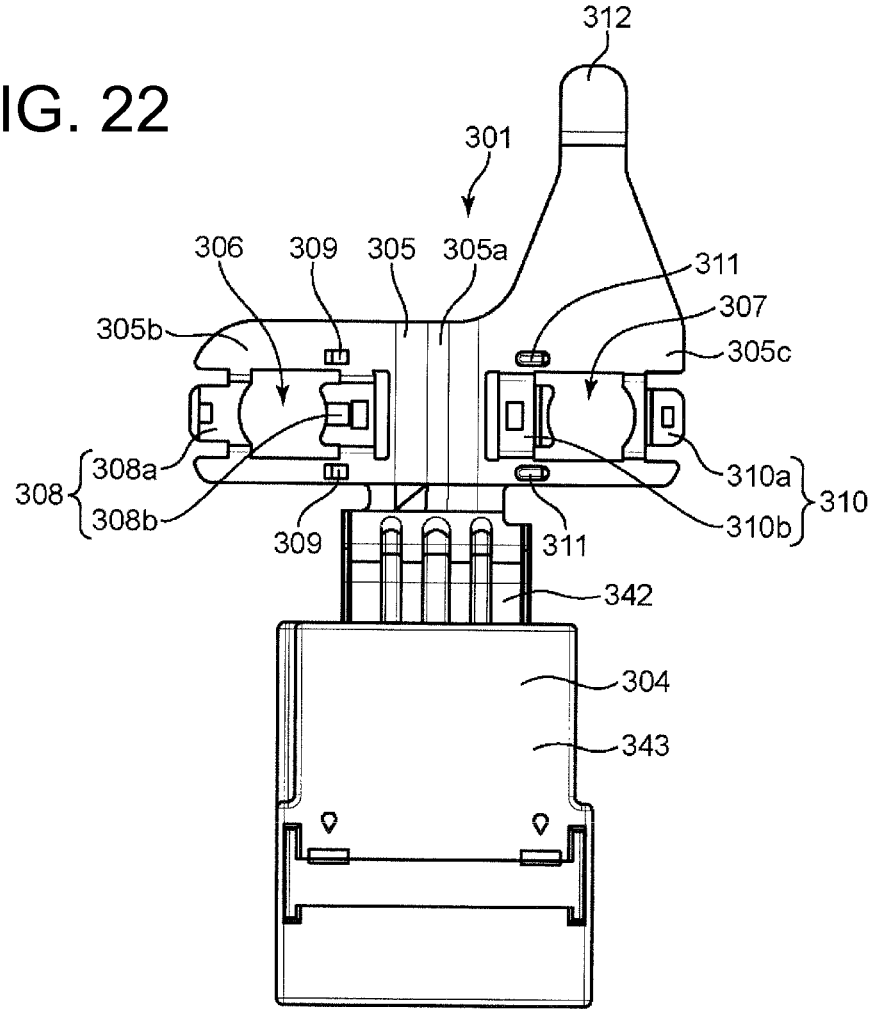
FIG. 22 is a plan view of the ground joint connector of FIG. 21.
Figure 23:
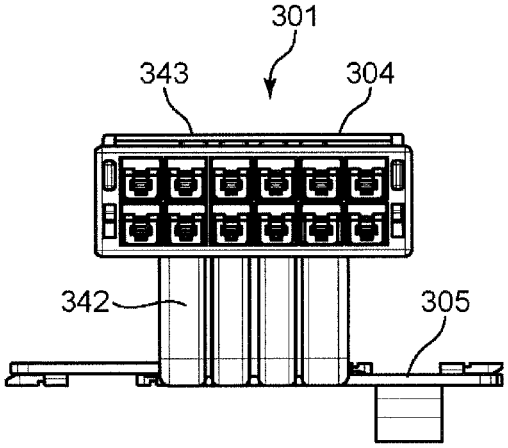
FIG. 23 is a view of the ground joint connector of FIG. 21 when viewed from a side from which ground wires are connected.

As shown in FIGS. 21 to 23, the joint connector 301 includes, as main constituent parts, a ground conductor 250 (see FIGS. 19 and 20) with the ground-side terminal portion 305, a connector housing 343, and wire terminals 234 (see FIGS. 19 and 20) in the connector housing 343. The wire terminals 234, wire-side terminal portions 240 (see FIGS. 19 and 20) of the ground conductor 250 and the connector housing 343 form the wire connecting portion 304 of the present invention. Further, the ground-side terminal portion 305 corresponds to the ground-side terminal portion of the present invention. That is, the joint connector 301 functionally includes the wire connecting portion 304 and the ground-side terminal portion 305.

In the joint connector 301 of the third embodiment, the wire-side terminal portions 240, the ground-side terminal portion 305, a step portion 342 and a coupling portion 241 are integrally joined to form one ground conductor 250 as in the second embodiment.

Figure 24:
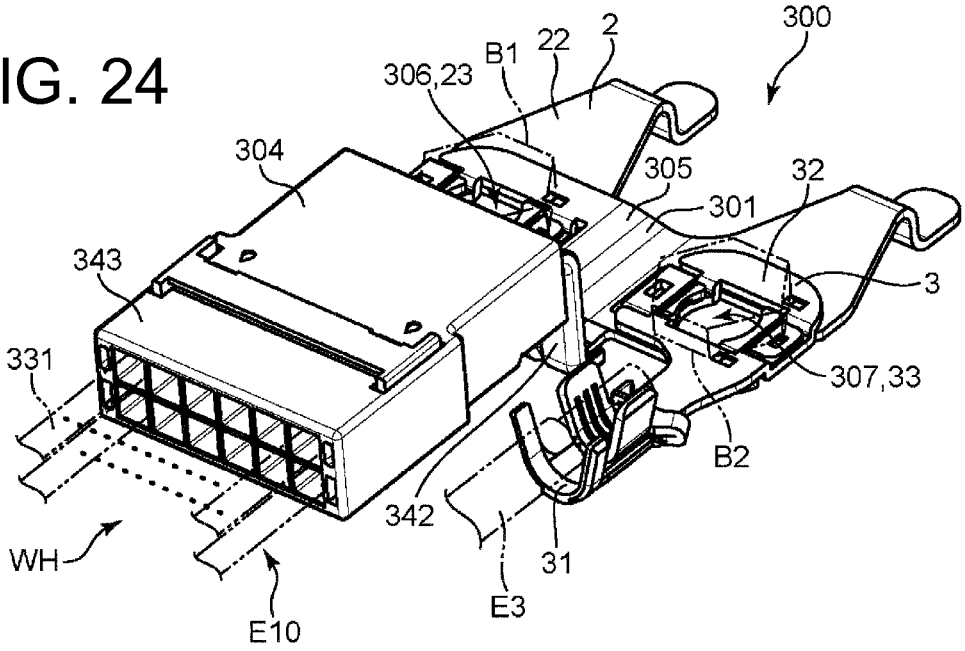
FIG. 24 is a perspective view of a ground connection device according to the third embodiment of the present invention.

As shown in FIG. 24, the wiring harness main body E10 composed of a plurality of (twelve in a shown example) ground wires 331 is connected to the wire connecting portion 304. The wiring harness WH is formed by joining the wiring harness main body E10 and the joint connector 301.

The wire connecting portion 304 has a configuration common to the wire connecting portion 221 of the above second embodiment and, specifically, includes the connector housing 343, a plurality of wire terminals 234, the wire-side terminal portions 240 and the coupling portion 241 (see FIG. 19) accommodated in the connector housing 343, and the step portion 342 projecting out from the connector housing 343. The wire connecting portion 304 can collectively connect the plurality of ground wires 331 constituting the wiring harness main body E10 to the ground-side terminal portion 305.

Figure 26:
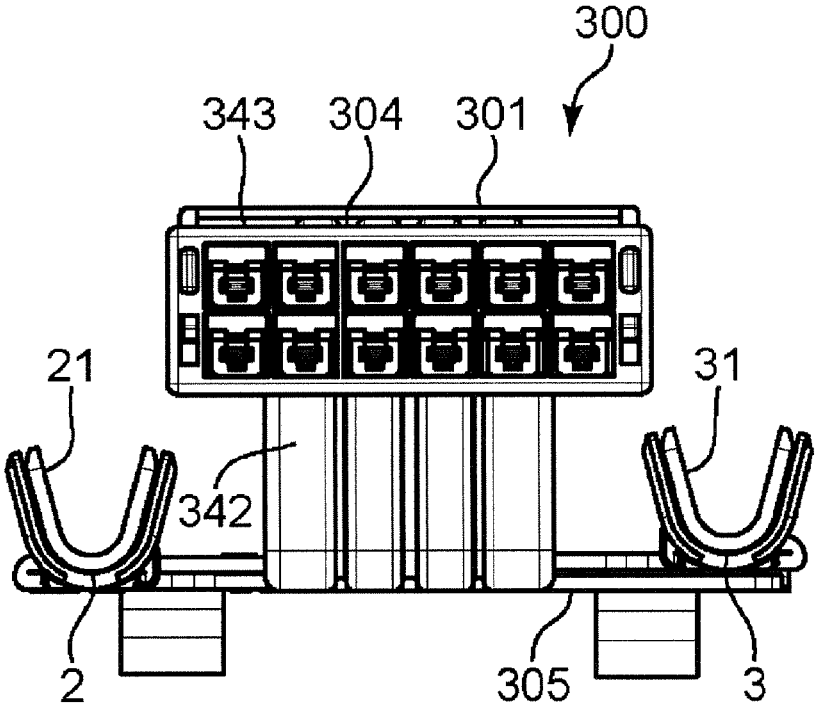
FIG. 26 is a view showing the ground connection device of FIG. 24 when viewed from a side from which the ground wires are connected.

Further, also in this wire connecting portion 304, the connector housing 343 can be arranged at a position distant from a second wire-side terminal portion 21 of the second ground terminal fitting 2 and a third wire-side terminal portion 31 of the third ground terminal fitting 3 as shown in FIGS. 24 and 26 by providing a level difference between the wire-side terminal portions 240 (see FIG. 19) and the ground-side terminal portion 305 in the connector housing 343 by the step portion 342 similarly to the wire connecting portion 221 of the above second embodiment, whereby a possibility of the interference of the harness main body E10 and the ground wires E2, E3 can be reduced.

As shown in FIG. 22, the ground-side terminal portion 305 has a configuration common to the first ground-side terminal portion 5 in the above first embodiment, is in the form of a flat plate including a step portion 305*a* and has a size capable of covering bolt holes formed on the wall surface of the vehicle with which the first and second bolts B1, B2 are respectively threadably engaged. The first ground-side terminal portion 305 is formed with a first bolt connection hole 306 as a connection part connectable to the first bolt B1 and a second bolt connection hole 307 as a connection part connectable to the second bolt B2 at positions corresponding to the arrangement of the bolt holes with which the first and second bolts B1, B2 are respectively threadably engaged. The first and second bolt connection holes 306, 307 are in such a relative positional relationship as to be simultaneously connectable to the first and second bolts B1, B2.

The step portion 305*a* is formed between the first and second bolt connection holes 306, 307. A first part 305*b* of the first ground-side terminal portion 305 where the first bolt connection hole 306 is formed is higher than a second part 305*c* where the second bolt connection hole 307 is formed. The first and second parts 305*b*, 305*c* are coupled by the step portion 305*a*.

Figure 25:
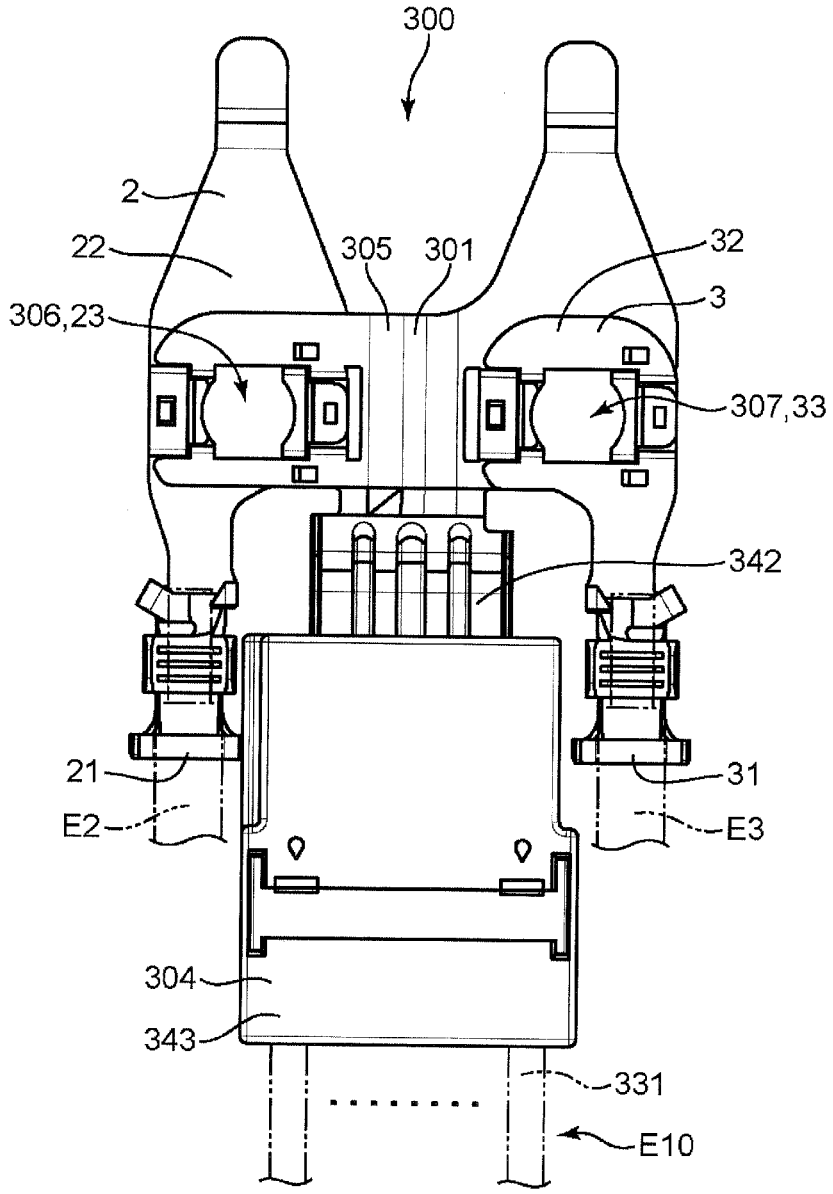
FIG. 25 is a plan view of the ground connection device of FIG. 24.

Since the first ground-side terminal portion 305 includes the step portion 305*a*, a second ground-side terminal portion 22 of the second ground terminal fitting 2 can be arranged below the first part 305*b* and a third ground-side terminal portion 32 of the third ground terminal fitting 3 can be arranged above the second part 305*c* as shown in FIGS. 24 to 25. A height difference between the first and second parts 305*b*, 305*c* is set at about the thickness of the second ground-side terminal portion 22.

Further, the first ground-side terminal portion 305 includes a first coupling portion 308 to be coupled to the second ground terminal fitting 2 and first press-contact portions 309 for pressing the ground terminal fitting 2 into contact with the first coupling portion 308 on the first part 305*b* thereof.

The first coupling portion 308 is coupled to the second ground-side terminal portion 22 in such a state where the first bolt connection hole 306 of the first ground-side terminal portion 305 and a first bolt connection hole 23 of the second ground-side terminal portion 22 of the second ground terminal fitting 2 are aligned so as to be simultaneously connectable to the first bolt B1.

Specifically, as shown in FIG. 22, the first coupling portion 308 includes contact pieces 308*a*, 308*b*. The contact pieces 308*a*, 308*b* are arranged at opposite sides of the first bolt connection hole 306 (opposite sides in an arrangement direction of the two connection holes 306, 307). The contact pieces 308*a*, 308*b* project in a horizontal direction away from the step portion 305*a*. Further, the contact pieces 308*a*, 308*b* are arranged at positions lower than the lower surface of the first part 305*b* of the first ground-side terminal portion 305. The contact pieces 308*a*, 308*b* can be engaged with contact pieces 24, 25 (see FIG. 7) of the second ground-side terminal portion 22 of the second ground terminal fitting 2.

The first press-contact portions 309 are parts projecting downward from the lower surface of the first part 305*b* of the first ground-side terminal portion 305. The first press-contact portions 309 are arranged at opposite sides (opposite sides in a direction perpendicular to the arrangement direction of the two connection holes 306, 307) of the contact piece 308*b*. The first press-contact portions 309 can press the contact pieces 24, of the second ground-side terminal portion 22 into contact with the contact pieces 308*a*, 308*b* of the first coupling portion 308 by pressing the second ground-side terminal portion 22 of the second ground terminal fitting 2 toward the contact pieces 308*a*, 308*b* of the first coupling portion 308.

Further, the first ground-side terminal portion 305 includes a second coupling portion 310 to be coupled to the third ground terminal fitting 3 and second press-contact portions 311 for pressing the ground terminal fitting 3 into contact with the second coupling portion 310 on the second part 305*c* thereof.

The second coupling portion 310 is coupled to the third ground-side terminal portion 32 in such a state where the second bolt connection hole 307 of the second ground-side terminal portion 305 and a second bolt connection hole 33 of the third ground-side terminal portion 32 of the third ground terminal fitting 3 are aligned so as to be simultaneously connectable to the second bolt B2.

Specifically, as shown in FIG. 22, the second coupling portion 310 includes contact pieces 310*a*, 310*b*. The contact pieces 310*a*, 310*b* are arranged at opposite sides of the second bolt connection hole 307 (opposite sides in the arrangement direction of the two connection holes 306, 307). The contact pieces 310*a*, 310*b* project in a horizontal direction away from the step portion 305*a* (specifically, in the direction opposite to the facing direction of the contact pieces 308*a*, 308*b*). Further, the contact pieces 310*a*, 310*b* are arranged at positions higher than the upper surface of the second part 305*c* of the first ground-side terminal portion 305. The contact pieces 310*a*, 310*b* can be engaged with contact pieces 34, 35 (see FIG. 7) of the third ground-side terminal portion 32 of the third ground terminal fitting 3.

The second press-contact portions 311 are parts projecting upward from the upper surface of the second part 305*c* of the first ground-side terminal portion 305. The second press-contact portions 311 are arranged at opposite sides (opposite sides in a direction perpendicular to the arrangement direction of the two connection holes 306, 307) of the contact piece 310*b*. The press-contact portions 311 can press the contact pieces 34, 35 of the third ground-side terminal portion 32 into contact with the contact pieces 310*a*, 310*b* of the second coupling portion 310 by pressing the third ground-side terminal portion 32 of the third ground terminal fitting 3 toward the contact pieces 310*a*, 310*b* of the second coupling portion 310.

Further, the second part 305*c* of the first ground-side terminal portion 305 is formed with a tongue piece 312 which is fitted into a hole formed on the wall surface at a position distant from the second bolt connection hole 307 to prevent the joint connector 301 from rotating about the bolts B1, B2.

Characteristics of Third Embodiment (1) In the joint connector 301 of the third embodiment, the ground-side terminal portion 305 is formed with the first bolt connection hole 306 connectable to the first bolt B1 and the second bolt connection hole 307 connectable to the second bolt B2 so as to be connectable to the first and second bolts B1, B2, and the first and second bolt connection holes 306, 307 are in such a relative positional relationship as to be simultaneously connectable to the first and second bolts B1, B2, which are a plurality of ground sections. Thus, if at least one ground section out of the first and second bolts B1, B2 is sufficiently connected, ground connection is achieved. Accordingly, the reliability of ground connection can be enhanced as compared with conventional ground terminals (particularly conventional ground joint connectors) for connecting a single ground connection part only to a single ground section.

(2) In the ground connection device 300 of the third embodiment, the joint connector 301 is adopted as the first connection fitting instead of the first ground terminal fitting 1. In the wire connecting portion 304 of this joint connector 301, the plurality of wire terminals 234 (see FIG. 19) mounted on the ends of the respective plurality of ground wires 331 can be fitted to the wire-side terminal portions 240 (see FIG. 19) in terminal accommodating chambers 245 (see FIG. 19) of the connector housing 343 similarly to the wire connecting portion 221 (see FIG. 19) of the above second embodiment. In addition, each wire-side terminal portion 240 is connected to the ground-side terminal portion 305 and the ground-side terminal portion 305 projects out from the connector housing 343. Thus, the ends of the plurality of ground wires 331 can be simultaneously connected to a plurality of ground-sides, i.e. the first and second bolts B1, B2. In addition, since variations of distances between each ground wire 331 and the first and second bolts B1, B2 as the ground sections can be suppressed low, a possibility of the occurrence of such a failure that a current flows between adjacent ground wires 331 without via the ground section can be reduced.

Fourth Embodiment

Figure 27:
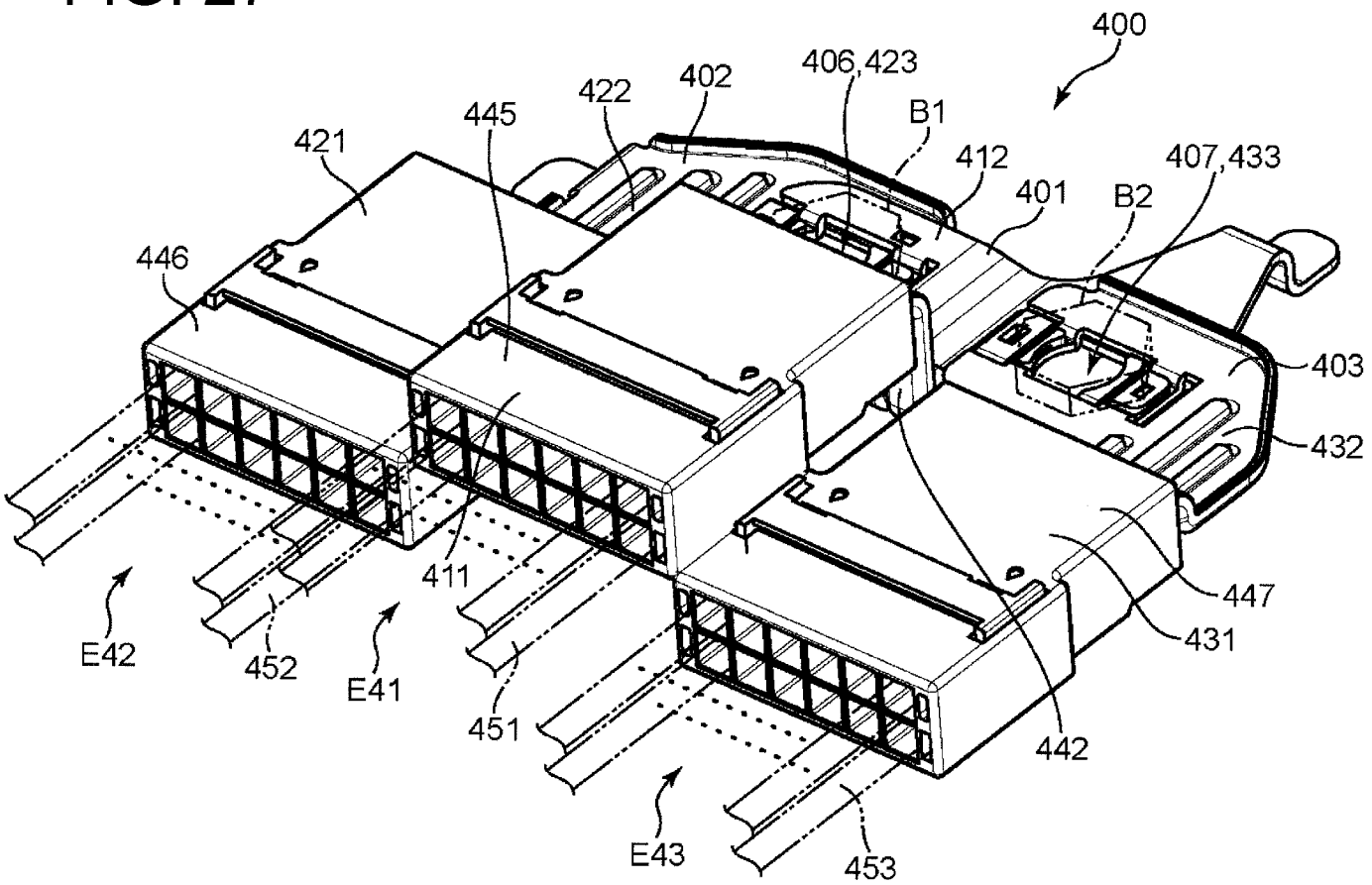
FIG. 27 is a perspective view of a ground connection device according to a fourth embodiment of the present invention.
Figure 28:
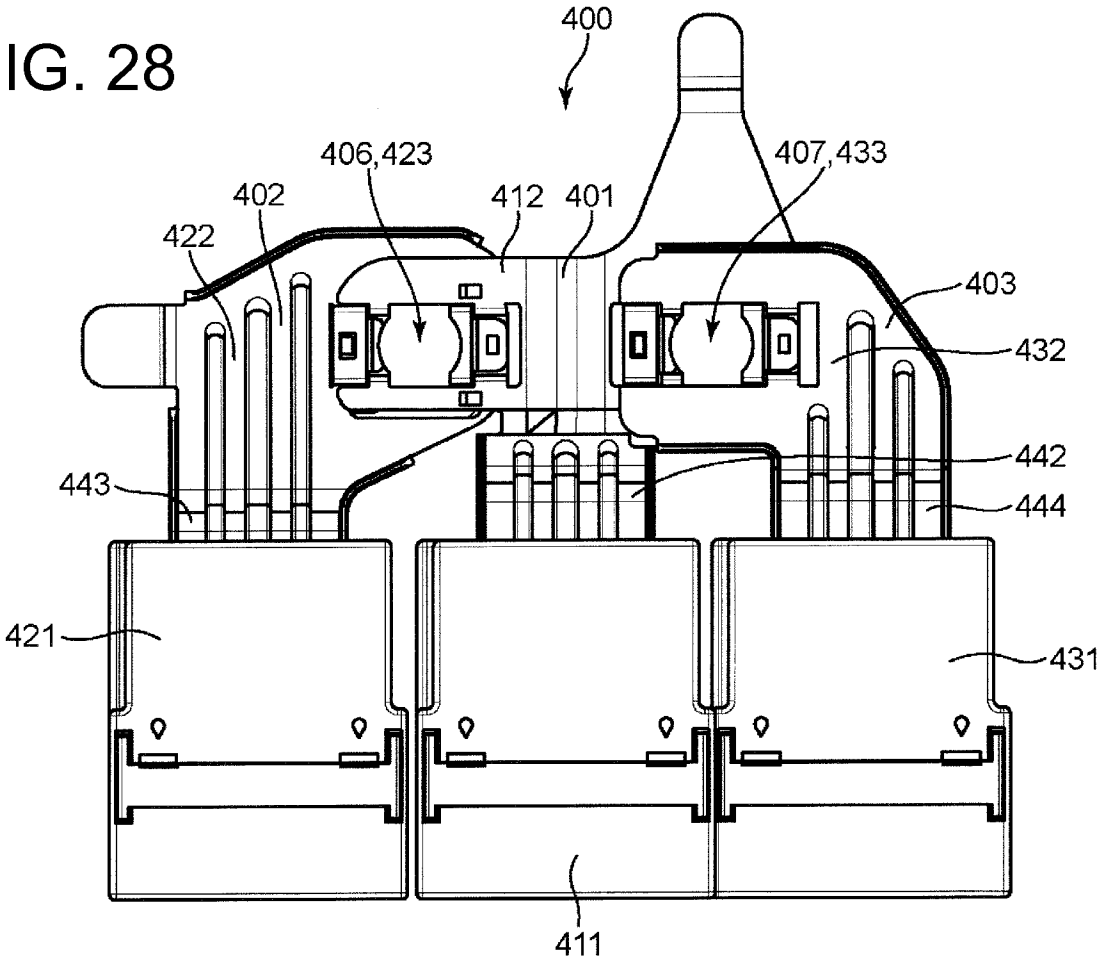
FIG. 28 is a plan view of the ground connection device of FIG. 27.
Figure 29:
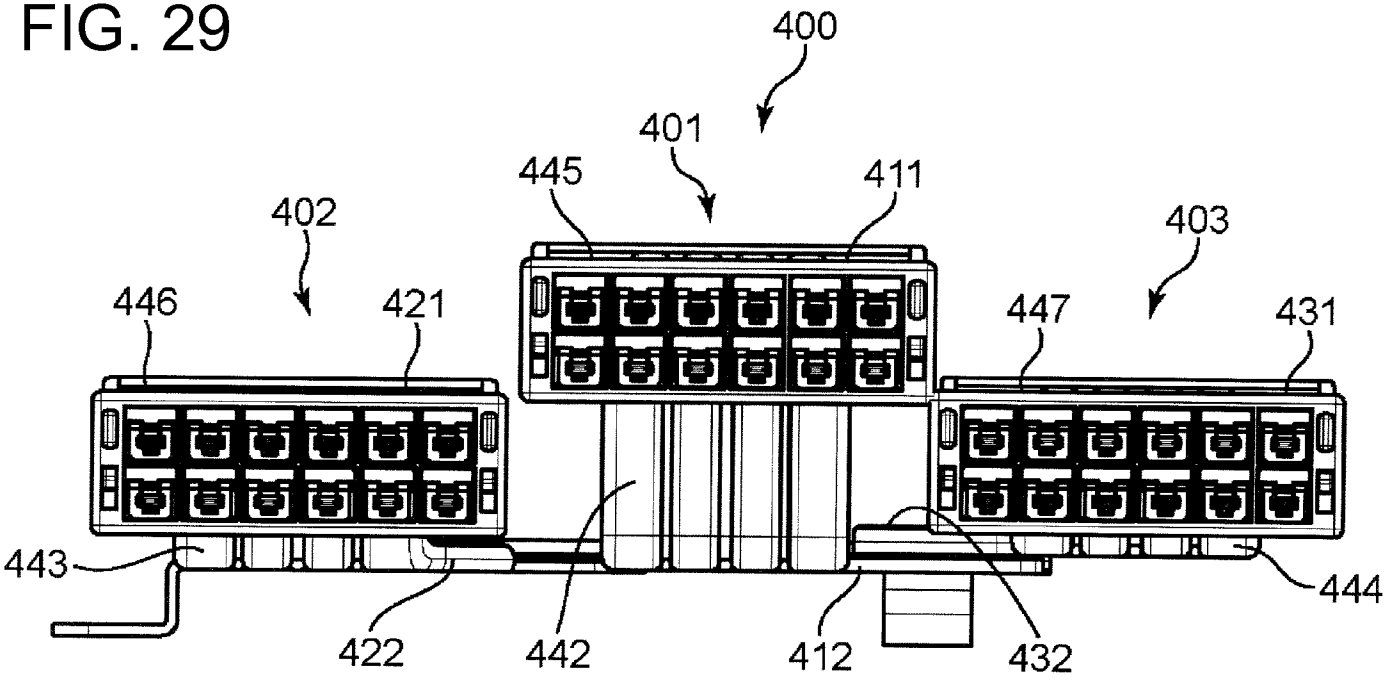
FIG. 29 is a view showing the ground connection device of FIG. 27 when viewed from a side from which ground wires are connected.

As yet another embodiment of the present invention, a ground connection device 400 in which three joint connectors are united as shown in FIGS. 27 to 29 may be configured by combining ground joint connectors including one hole connectable to one ground section in the second embodiment and a ground joint connector including two holes simultaneously connectable to two ground sections in the third embodiment.

This ground connection device 400 includes a first joint connector 401 connectable to two ground sections and a second joint connector 402 and a third joint connector 403 connectable to one ground section. The ground connection device 400 is so structured that a second ground-side terminal portion 422 of the second joint connector 402 and a third ground-side terminal portion 432 of the third joint connector 403 are arranged on upper and lower sides of a first ground-side terminal portion 412 of the first joint connector 401.

In the ground connection device 400 of this fourth embodiment, the first joint connector 401 corresponds to the first ground connection fitting of the present invention, the second joint connector 402 to the second ground connection fitting of the present invention and the third joint connector 403 to the third ground connection fitting of the present invention.

The first joint connector 401 has the same configuration as the joint connector 301 (see FIGS. 21 to 23) of the above third embodiment and includes a first wire connecting portion 411 and the first ground-side terminal portion 412. The first ground-side terminal portion 412 includes a first bolt connection hole 406 connectable to a first bolt B1 and a second bolt connection hole 407 connectable to a second bolt B2.

The second joint connector 402 has the same configuration as the joint connector 201 (see FIGS. 14 to 20) of the above second embodiment and includes a second wire connecting portion 421 and the second ground-side terminal portion 422. The second ground-side terminal portion 422 includes a first bolt connection hole 423 connectable to the first bolt B1. Similarly to the ground-side terminal portion 222 of the above second embodiment, the second ground-side terminal portion 422 is coupled to the lower side of the first ground-side terminal portion 412 so that the two first bolt connection holes 406, 423 overlap. The first bolt B1 can be inserted into the first bolt connection holes 406, 423.

The third joint connector 403 has the same configuration as the joint connector 201 (see FIGS. 14 to 20) of the above second embodiment, but differs therefrom in that the ground-side terminal portion 432 is facing in an opposite direction. Specifically, a part of the ground-side terminal portion 432 where a second bolt connection hole 433 is formed projects in a direction from the second bolt connection hole 407 toward the first bolt connection hole 406. The third joint connector 403 includes a third wire connecting portion 431 and the third ground-side terminal portion 432. The third ground-side terminal portion 432 includes the second bolt connection hole 433 connectable to the second bolt B2. Similarly to the third ground-side terminal portion 32 of the third ground terminal fitting 3 of the above first, second and third embodiments, the third ground-side terminal portion 432 is coupled to the upper side of the first ground-side terminal portion 412 so that the two second bolt connection holes 407, 433 overlap. The second bolt B2 can be inserted into the second bolt connection holes 407, 433.

A harness main body E41 as a collection of a plurality of ground wires 451 is connected to the wire connecting portion 411 of the first joint connector 401 to form one wiring harness. Similarly, a harness main body E42 as a collection of a plurality of ground wires 452 is connected to the wire connecting portion 421 of the second joint connector 402, and a harness main body E43 as a collection of a plurality of ground wires 453 is connected to the wire connecting portion 431 of the third joint connector 403, thereby respectively forming one wiring harness.

The first joint connector 401 can be connected to both the first bolt B1 as the first ground section fixed to a wall surface of a vehicle and the second bolt B2 as the second ground section similarly to the joint connector 301 of the above third embodiment and can collectively connect the plurality of ground wires 451 constituting the harness main body E41 to the first and second bolts B1, B2 via the ground connection device 400.

The second joint connector 402 connects the respective ground wires 452 of the harness main body E42 to the first bolt B1 and also to the second bolt B2 via the ground-side terminal portion 412 of the first joint connector 401. Similarly, the third joint connector 403 connects the respective ground wires 453 of the harness main body E43 to the second bolt B2 and also to the first bolt B1 via the ground-side terminal portion 412 of the first joint connector 401.

Further, a length of a step portion 442 of the first wire connecting portion 411 is set to be longer than that of a step portion 443 of the second wire connecting portion 421 and that of a step portion 444 of the third wire connecting portion 431. In this way, as shown in FIGS. 27 to 29, a connector housing 445 of the first wire connecting portion 411 can be arranged at a position distant from a connector housing 446 of the second wire connecting portion 421 and a connector housing 447 of the third wire connecting portion 431. Thus, it is possible to reduce a possibility of the interference of the harness main body E41 located in the center of the ground connection device 400 with the harness main bodies E42, E43 on opposite sides.

Characteristics of Fourth Embodiment (1) The ground connection device 400 of the fourth embodiment is configured by combining the first joint connector 401 connectable to two ground sections and the second and third joint connectors 402, 403 connected at the opposite sides of the first joint connector 401. Thus, a plurality of wire terminals 234 (see FIG. 19) respectively mounted on ends of a plurality of ground wires 451 to 453 can be connected to wire-side terminal portions 240 (see FIG. 19) in terminal accommodating chambers 245 (see FIG. 19) of the respective connector housings 445 to 447. In addition, the respective wire-side terminal portion 240 are connected to the ground-side terminal portions 412, 422 and 432, and the ground-side terminal portions 412, 422 and 423 respectively project out from the connector housings 445 to 447. Thus, the ends of the plurality of ground wires 451 to 453 can be simultaneously connected to a plurality of ground sections, i.e. the first and third bolts B1, B2. In addition, since variations of distances between each ground wire 451 to 453 and the first and third bolts B1, B2 as the ground sections can be suppressed low, a possibility of the occurrence of such a failure that a current flows between adjacent ground wires 451 to 453 without via the ground section can be reduced.

(2) Further, since the ground connection device 400 of the fourth embodiment is configured by three joint connectors 401 to 403, it is possible to simultaneously connect numerous ground wires 451 to 453 to the first and second bolts B1, B2, which are a plurality of ground sections, within a limited installation space.

Note that the aforementioned specific embodiments mainly include inventions having the following configurations.

The above ground connection fitting is a ground connection fitting for connecting at least one ground wire to a plurality of ground sections provided on a wall surface in a vehicle and includes a wire connecting portion shaped to be connectable to an end of the at least one ground wire, and a ground-side terminal portion including a first ground section connection part connectable to a first ground section and a second ground section connection part connectable to a second ground section different from the first ground section and having such a relative positional relationship that the first and second ground section connection parts are simultaneously connectable to the first and second ground sections.

According to such a configuration, the ground-side terminal portion includes the first ground section connection part connectable to the first ground section and the second ground section connection part connectable to the second ground section so as to be connectable to a plurality of ground sections and has such a relative positional relationship that the first and second ground section connection parts are simultaneously connectable to the first and second ground sections. Thus, if at least one of the ground sections is sufficiently connected, ground connection is achieved. Accordingly, the reliability of ground connection can be enhanced as compared with conventional ground terminals for connecting a single ground connection part only to a single ground section.

Preferably, the wire connecting portion is shaped to be mountable on the end of the at least one ground wire, and the wire connecting portion and the ground-side terminal portion are integrally formed to form a ground terminal fitting.

According to such a configuration, it is possible to simultaneously connect end(s) of one or more ground wires to the plurality of ground sections. Further, since the wire connecting portion and the ground-side terminal portion are integrally formed to form the ground terminal fitting, the manufacturing of the ground terminal fitting and parts management are easy.

Preferably, the wire connecting portion includes a plurality of wire terminals to be respectively mounted on ends of a plurality of the ground wires, a plurality of wire-side terminal portions shaped to be fittable to the respective wire terminals in a common specific terminal fitting direction, and a connector housing including a plurality of terminal accommodating chambers into which the respective wire terminals are insertable through openings formed to be open in one direction parallel to the terminal fitting direction and terminal locking portions for locking the wire terminals inserted into the respective terminal accommodating chambers, the wire-side terminal portions are arranged in a direction substantially perpendicular to the terminal fitting direction and substantially parallel to the wall surface, the ground-side terminal portion is connected to each wire-side terminal portion, the wire-side terminal portion is so accommodated in each terminal accommodating chamber in the connector housing that the wire terminal is locked by the terminal locking portion in a state where the wire terminal inserted in each terminal accommodating chamber is fitted to the corresponding wire-side terminal portion, and the connector housing holds the ground-side terminal portion in such a manner that the ground-side terminal portion projects out from the connector housing at a side opposite to the openings of the respective terminal accommodating chambers.

According to such a configuration, in the wire connecting portion, the plurality of wire terminals mounted on the ends of the respective plurality of ground wires can be fitted to the wire-side terminal portions in the terminal accommodating chambers of the connector housing. In addition, each wire-side terminal portion is connected to the ground-side terminal portion and the ground-side terminal portion projects out from the connector housing. Thus, it is possible to simultaneously connect the ends of the plurality of ground wires to the plurality of ground sections. In addition, since variations of distances between each ground wire and the ground sections can be suppressed low, a possibility of the occurrence of such a failure that a current flows between adjacent ground wires without via the ground section can be reduced.

Further, the above ground connection device is a ground connection device for collectively connecting ground wires to a plurality of ground sections provided on a wall surface in a vehicle and includes a first ground connection fitting with a first wire connecting portion shaped to be connectable to an end of at least one first ground wire and a first ground-side terminal portion including a first ground section connection part connectable to a first ground section and a second ground section connection part adjacent to the first connection part and connectable to a second ground section different from the first ground section and having such a relative positional relationship that the first and second ground section connection parts are simultaneously connectable to the first and second ground sections, and a second ground connection fitting with a second wire connecting portion shaped to be connectable to an end of at least one second ground wire different from the first ground wire and a second ground-side terminal portion formed with a first ground section connection part connectable to the first ground section, and the first ground-side terminal portion includes a first coupling portion to be coupled to the second ground-side terminal portion in a state having such a positional relationship that the first ground section connection part of the first ground-side terminal portion and that of the second ground-side terminal portion are simultaneously connectable to the first ground section and a first press-contact portion for pressing the second ground-side terminal portion into contact with the first coupling portion by pressing the second ground-side terminal portion toward the first coupling portion.

According to such a configuration, the first ground-side terminal portion of the first ground connection fitting includes the first ground section connection part connectable to the first ground section and the second ground section connection part connectable to the second ground section so as to be connectable to a plurality of ground sections, and the first ground section connection part and the second ground section connection part are in such a relative positional relationship as to be simultaneously connectable to the first and second ground sections. Thus, if at least one of the ground sections is sufficiently connected, ground connection is achieved. Accordingly, the reliability of ground connection can be enhanced as compared with conventional ground terminals for connecting a single ground connection part only to a single ground section.

Further, the second ground-side terminal portion of the second ground connection fitting is coupled to the first coupling portion of the first ground-side terminal portion of the first ground connection fitting in the state having such a relative positional relationship that the first ground section connection part of the first ground-side terminal portion and that of the second ground-side terminal portion are simultaneously connectable to the first ground section in connecting the second ground connection fitting to the first ground section. The second ground-side terminal portion can be pressed into contact with the first coupling portion by being pressed toward the first coupling portion by the first press-contact portion. In this way, the second ground connection fitting can be connected and grounded to the second ground section via the first ground-side terminal portion of the first ground connection fitting. Thus, it is possible to reliably ground two ground connection fittings by respectively connecting them to two ground sections.

Preferably, the first wire connecting portion includes a plurality of first wire terminals to be respectively mounted on ends of a plurality of the ground wires, a plurality of first wire-side terminal portions shaped to be fittable to the respective first wire terminals in a common specific terminal fitting direction, and a first connector housing including a plurality of terminal accommodating chambers into which the respective first wire terminals are insertable through openings formed to be open in one direction parallel to the terminal fitting direction and terminal locking portions for locking the first wire terminals inserted into the respective terminal accommodating chambers, the first wire-side terminal portions are arranged in a direction substantially perpendicular to the terminal fitting direction and substantially parallel to the wall surface, the first ground-side terminal portion is connected to each first wire-side terminal portion, the first wire-side terminal portion is so accommodated in each terminal accommodating chamber in the first connector housing that the first wire terminal is locked by the terminal locking portion in a state where the first wire terminal inserted in each terminal accommodating chamber is fitted to the corresponding first wire-side terminal portion, and the first connector housing holds the first ground-side terminal portion in such a manner that the first ground-side terminal portion projects out from the first connector housing at a side opposite to the openings of the respective terminal accommodating chambers.

According to such a configuration, in the first wire connecting portion, the plurality of first wire terminals mounted on the ends of the respective plurality of ground wires can be fitted to the first wire-side terminal portions in the terminal accommodating chambers of the first connector housing. In addition, each first wire-side terminal portion is connected to the first ground-side terminal portion and the first ground-side terminal portion projects out from the first connector housing. Thus, it is possible to simultaneously connect the ends of the plurality of ground wires to the plurality of ground sections. In addition, since variations of distances between each ground wire and the ground sections can be suppressed low, a possibility of the occurrence of such a failure that a current flows between adjacent ground wires without via the ground section can be reduced.

Preferably, the second wire connecting portion includes a plurality of second wire terminals to be respectively mounted on ends of a plurality of the ground wires, a plurality of second wire-side terminal portions shaped to be fittable to the respective second wire terminals in a common specific terminal fitting direction, and a second connector housing including a plurality of terminal accommodating chambers into which the respective second wire terminals are insertable through openings formed to be open in one direction parallel to the terminal fitting direction and terminal locking portions for locking the second wire terminals inserted into the respective terminal accommodating chambers, the second wire-side terminal portions are arranged in a direction substantially perpendicular to the terminal fitting direction and substantially parallel to the wall surface, the second ground-side terminal portion is connected to each second wire-side terminal portion, the second wire-side terminal portion is so accommodated in each terminal accommodating chamber in the second connector housing that the second wire terminal is locked by the terminal locking portion in a state where the second wire terminal inserted in each terminal accommodating chamber is fitted to the corresponding second wire-side terminal portion, and the second connector housing holds the second ground-side terminal portion in such a manner that the second ground-side terminal portion projects out from the second connector housing at a side opposite to the openings of the respective terminal accommodating chambers.

According to such a configuration, in the second wire connecting portion, the plurality of second wire terminals mounted on the ends of the respective plurality of ground wires can be fitted to the second wire-side terminal portions in the terminal accommodating chambers of the second connector housing. In addition, each second wire-side terminal portion is connected to the second ground-side terminal portion and the second ground-side terminal portion projects out from the second connector housing. Thus, it is possible to simultaneously connect the ends of the plurality of ground wires to the plurality of ground sections. In addition, since variations of distances between each ground wire and the ground sections can be suppressed low, a possibility of the occurrence of such a failure that a current flows between adjacent ground wires without via the ground section can be reduced.

Preferably, a third ground connection fitting is further provided which includes a third wire connecting portion shaped to be connectable to an end of at least one third ground wire different from the first and second ground wires and a third ground-side terminal portion formed with a second ground section connection part connectable to the second ground section, and the first ground-side terminal portion includes a second coupling portion to be coupled to the third ground-side terminal portion in a state having such a relative positional relationship that the second ground section connection part of the first ground-side terminal portion and that of the third ground-side terminal portion are simultaneously connectable to the second ground section, and a second press-contact portion for pressing the third ground-side terminal portion into contact with the second coupling portion by pressing the third ground-side terminal portion toward the second coupling portion.

According to such a configuration, the third ground-side terminal portion of the third ground connection fitting is coupled to the second coupling portion of the first ground-side terminal portion of the first ground connection fitting in the state having such a relative positional relationship that the second ground section connection part of the first ground-side terminal portion and that of the third ground-side terminal portion are simultaneously connectable to the second ground section in connecting the third ground connection fitting to the second ground section. The third ground-side terminal portion can be pressed into contact with the second coupling portion by being pressed toward the second coupling portion by the second press-contact portion. In this way, the third ground connection fitting can be connected and grounded to the first ground section via the first ground-side terminal portion of the first ground connection fitting. Thus, it is possible to reliably ground the first to third ground connection fittings by respectively connecting them to two ground sections.

Preferably, the third wire connecting portion includes a plurality of third wire terminals to be respectively mounted on ends of a plurality of the ground wires, a plurality of third wire-side terminal portions shaped to be fittable to the respective third wire terminals in a common specific terminal fitting direction, and a third connector housing including a plurality of terminal accommodating chambers into which the respective third wire terminals are insertable through openings formed to be open in one direction parallel to the terminal fitting direction and terminal locking portions for locking the third wire terminals inserted into the respective terminal accommodating chambers, the third wire-side terminal portions are arranged in a direction substantially perpendicular to the terminal fitting direction and substantially parallel to the wall surface, the third ground-side terminal portion is connected to each third wire-side terminal portion, the third wire-side terminal portion is so accommodated in each terminal accommodating chamber in the third connector housing that the third wire terminal is locked by the terminal locking portion in a state where the third wire terminal inserted in each terminal accommodating chamber is fitted to the corresponding third wire-side terminal portion, and the third connector housing holds the third ground-side terminal portion in such a manner that the third ground-side terminal portion projects out from the third connector housing at a side opposite to the openings of the respective terminal accommodating chambers.

According to such a configuration, in the third wire connecting portion, the plurality of third wire terminals mounted on the ends of the respective plurality of ground wires can be fitted to the third wire-side terminal portions in the terminal accommodating chambers of the third connector housing. In addition, each third wire-side terminal portion is connected to the third ground-side terminal portion and the third ground-side terminal portion projects out from the third connector housing. Thus, it is possible to simultaneously connect the ends of the plurality of ground wires to the plurality of ground sections. In addition, since variations of distances between each ground wire and the ground sections can be suppressed low, a possibility of the occurrence of such a failure that a current flows between adjacent ground wires without via the ground section can be reduced.

Further, if all of the first, second and third ground connection fittings are formed by joint connectors, it is possible to simultaneously connect numerous ground wires to a plurality of ground sections within a limited installation space.

Furthermore, preferably, the second ground-side terminal portion is so coupled to the first coupling portion as to be located below the first ground-side terminal portion and the third ground-side terminal portion is so coupled to the second coupling portion as to be located above the first ground-side terminal portion.

According to such a configuration, the second and third ground-side terminal portions can be separately arranged on upper and lower sides of the first ground-side terminal portion by coupling the second ground-side terminal portion to the lower side of the first ground-side terminal portion and coupling the third ground-side terminal portion to the upper side of the first ground-side terminal portion. In this way, when the second and third ground-side terminal portions are respectively coupled to the first ground-side terminal portion, an operation of coupling the second and third ground-side terminal portions can be easily and smoothly performed without the second and third ground-side terminal portions interfering with each other.

Furthermore, the lower surface of a part of the first ground-side terminal portion located below the third ground-side terminal portion is preferably at the same height as the lower surface of the second ground-side terminal portion.

According to such a configuration, the lower surface of the part of the first ground-side terminal portion located below the third ground-side terminal portion is flush with the lower surface of the second ground-side terminal portion, i.e. there is no level difference between this lower surface and the lower surface of the second ground-side terminal portion with the second and third ground-side terminal portions coupled to the first ground-side terminal portion. Thus, when being fixed to the wall surface or the like of the vehicle, the ground connection device can be stably fixed by bolts for ground connection or the like with the respective lower surfaces of the first and second ground-side terminal portions held in contact with the wall surface.

The invention claimed is:

1. A ground connection device for collectively connecting ground wires to first and second ground sections provided on a wall surface in a vehicle and spaced from one another along an arrangement direction, comprising:

a first ground connection fitting with a first wire connecting portion projecting transverse to the arrangement direction and shaped to be connectable to an end of at least one first ground wire and a first ground-side terminal portion defining a plate extending in the arrangement direction and having opposite upper and lower surfaces, the first ground-side terminal portion including a first ground section connection part connectable to the first ground section and a second ground section connection part connectable to the second ground section and having a step between the first and second ground section connection parts, the first and second ground section connection parts being formed respectively with first and second press-contact portions and first and second coupling portions;

a second ground connection fitting with a second wire connecting portion shaped to be connectable to an end of at least one second ground wire different from the first ground wire and a second ground-side terminal portion including a first ground section connection part that is pressed by the first press-contact portion into contact with the first coupling portion at the lower surface of the first ground-side terminal portion for simultaneous connection of the first ground section connection parts of the first and second ground connection fittings to the first ground section; and a third ground connection fitting with a third wire connecting portion shaped to be connectable to an end of at least one third ground wire different from the first and second ground wires and a third ground-side terminal portion including a second ground section connection part that is pressed by the second press-contact portion into contact with the second coupling portion at the upper surface of the first ground-side terminal portion for simultaneous connection of the second ground section connection parts of the first and third ground connection fittings to the second ground section, wherein the lower surface of a part of the first ground-side terminal portion located below the third ground-side terminal portion is at the same height as a lower surface of the second ground-side terminal portion.

2. The ground connection device of claim 1, wherein:

the first wire connecting portion includes:

a plurality of first wire terminals to be respectively mounted on ends of a plurality of the ground wires, a plurality of first wire-side terminal portions shaped to fit to the respective first wire terminals in a common specific terminal fitting direction, and a first connector housing including a plurality of terminal accommodating chambers into which the respective first wire terminals are insertable through openings formed to be open in one direction parallel to the terminal fitting direction and terminal locking portions for locking the first wire terminals inserted into the respective terminal accommodating chambers;

the first wire-side terminal portions are arranged in a direction substantially perpendicular to the terminal fitting direction and substantially parallel to the wall surface;

the first ground-side terminal portion is connected to each first wire-side terminal portion;

the first wire-side terminal portion is so accommodated in each terminal accommodating chamber in the first connector housing that the first wire terminal is locked by the terminal locking portion in a state where the first wire terminal inserted in each terminal accommodating chamber is fit to the corresponding first wire-side terminal portion; and the first connector housing holds the first ground-side terminal portion in such a manner that the first ground-side terminal portion projects out from the first connector housing at a side opposite to the openings of the respective terminal accommodating chambers.

3. The ground connection device of claim 2, wherein:

the second wire connecting portion includes:

a plurality of second wire terminals to be respectively mounted on ends of a plurality of the ground wires, a plurality of second wire-side terminal portions shaped to fit to the respective second wire terminals in a common specific terminal fitting direction, and a second connector housing including a plurality of terminal accommodating chambers into which the respective second wire terminals are insertable through openings formed to be open in one direction parallel to the terminal fitting direction and terminal locking portions for locking the second wire terminals inserted into the respective terminal accommodating chambers;

the second wire-side terminal portions are arranged in a direction substantially perpendicular to the terminal fitting direction and substantially parallel to the wall surface;

the second ground-side terminal portion is connected to each second wire-side terminal portion;

the second wire-side terminal portion is so accommodated in each terminal accommodating chamber in the second connector housing that the second wire terminal is locked by the terminal locking portion in a state where the second wire terminal inserted in each terminal accommodating chamber is fit to the corresponding second wire-side terminal portion; and the second connector housing holds the second ground-side terminal portion in such a manner that the second ground-side terminal portion projects out from the second connector housing at a side opposite to the openings of the respective terminal accommodating chambers.

4. The ground connection device of claim 3, wherein:

the third wire connecting portion includes:

a plurality of third wire terminals to be respectively mounted on ends of a plurality of the ground wires, a plurality of third wire-side terminal portions shaped to fit to the respective third wire terminals in a common specific terminal fitting direction, and a third connector housing including a plurality of terminal accommodating chambers into which the respective third wire terminals are insertable through openings formed to be open in one direction parallel to the terminal fitting direction and terminal locking portions for locking the third wire terminals inserted into the respective terminal accommodating chamber;

the third wire-side terminal portions are arranged in a direction substantially perpendicular to the terminal fitting direction and substantially parallel to the wall surface;

the third ground-side terminal portion is connected to each third wire-side terminal portion;

the third wire-side terminal portion is so accommodated in each terminal accommodating chamber in the third connector housing that the third wire terminal is locked by the terminal locking portion in a state where the third wire terminal inserted in each terminal accommodating chamber is fit to the corresponding third wire-side terminal portion; and the third connector housing holds the third ground-side terminal portion in such a manner that the third ground-side terminal portion projects out from the third connector housing at a side opposite to the openings of the respective terminal accommodating chambers.

5. The ground connection device of claim 2, wherein:

the second wire connecting portion is a wire crimping portion configured for crimped connection to the second ground wire and disposed substantially adjacent a side of the first connector housing.

6. The ground connection device of claim 5, the third wire connecting portion is a wire crimping portion configured for crimped connection to the third ground wire and disposed substantially adjacent a side of the first connector housing opposite the second wire connecting portion.

7. A ground connection device according to claim 1, wherein:

the second wire connecting portion includes:

a plurality of second wire terminals to be respectively mounted on ends of a plurality of the ground wires, a plurality of second wire-side terminal portions shaped to fit to the respective second wire terminals in a common specific terminal fitting direction, and a second connector housing including a plurality of terminal accommodating chambers into which the respective second wire terminals are insertable through openings formed to be open in one direction parallel to the terminal fitting direction and terminal locking portions for locking the second wire terminals inserted into the respective terminal accommodating chamber;

the second wire-side terminal portions are arranged in a direction substantially perpendicular to the terminal fitting direction and substantially parallel to the wall surface;

the second ground-side terminal portion is connected to each second wire-side terminal portion;

the second wire-side terminal portion is so accommodated in each terminal accommodating chamber in the second connector housing that the second wire terminal is locked by the terminal locking portion in a state where the second wire terminal inserted in each terminal accommodating chamber is fit to the corresponding second wire-side terminal portion; and the second connector housing holds the second ground-side terminal portion in such a manner that the second ground-side terminal portion projects out from the second connector housing at a side opposite to the openings of the respective terminal accommodating chambers.

8. A ground connection device for collectively connecting ground wires to first and second ground sections provided on a wall surface in a vehicle and spaced from one another along an arrangement direction, comprising:

a first connector housing with a plurality of first terminal accommodating chambers arranged parallel to the arrangement direction with each of the first terminal accommodating chambers extending perpendicular to the arrangement direction and formed with a terminal lock, a plurality of first wire terminals to be mounted respectively on ends of a plurality of the ground wires and locked respectively in the first terminal accommodating chambers by the terminal locks;

a first ground connection fitting with a first ground-side terminal portion defining a plate extending in the arrangement direction and having a first ground section connection part connectable to the first ground section and a second ground section connection part connectable to the second ground section, the first and second ground section connection parts being formed respectively with first and second press-contact portions and first and second coupling portions, a plurality of first wire-side terminal portions shaped to fit into the first terminal accommodating chambers and to mate with the respective first wire terminals in a common specific terminal fitting direction;

a second ground connection fitting with a second wire connecting portion shaped to be connectable to an end of at least one second ground wire at a lateral side of the first connector housing and a second ground-side terminal portion including a first ground section connection part that is pressed by the first press-contact portion into contact with the first coupling portion of the first ground-side terminal portion for simultaneous connection of the first ground section connection parts of the first and second ground connection fittings to the first ground section; and a third ground connection fitting with a third wire connecting portion shaped to be connectable to an end of at least one third ground wire at a lateral side of the first connector housing opposite the second wire connecting portion and a third ground-side terminal portion including a second ground section connection part that is pressed by the second press-contact portion into contact with the second coupling portion of the first ground-side terminal portion for simultaneous connection of the second ground section connection parts of the first and third ground connection fittings to the second ground section.

9. The ground connection device of claim 8, wherein:

the second ground-side terminal portion is so coupled to the first coupling portion as to be located below the first ground-side terminal portion; and the third ground-side terminal portion is so coupled to the second coupling portion as to be located above the first ground-side terminal portion.

10. The ground connection device of claim 9, wherein:

the lower surface of a part of the first ground-side terminal portion located below the third ground-side terminal portion is at the same height as the lower surface of the second ground-side terminal portion.

11. The ground connection device of claim 8, further comprising:

a second connector housing laterally adjacent the first connector housing in the arrangement direction and formed with a plurality of second terminal accommodating chambers arranged parallel to the arrangement direction with each of the second terminal accommodating chambers extending perpendicular to the arrangement direction and formed with a terminal lock, a plurality of second wire terminals to be mounted respectively on ends of a plurality of the ground wires and locked respectively in the second terminal accommodating chambers by the terminal locks, and wherein the second wire connecting portion includes a plurality of second wire-side terminal portions shaped to fit into the second terminal accommodating chambers and to mate with the respective second wire terminals in a common specific terminal fitting direction.

12. The ground connection device of claim 11, further comprising:

a third connector housing laterally adjacent the first connector housing in the arrangement direction and on a side of the first connector housing opposite the second connector housing, the third connector housing being formed with a plurality of third terminal accommodating chambers arranged parallel to the arrangement direction with each of the third terminal accommodating chambers extending perpendicular to the arrangement direction and formed with a terminal lock, a plurality of third wire terminals to be mounted respectively on ends of a plurality of the ground wires and locked respectively in the third terminal accommodating chambers by the terminal locks, and wherein the third wire connecting portion includes a plurality of third wire-side terminal portions shaped to fit into the third terminal accommodating chambers and to mate with the respective third wire terminals in a common specific terminal fitting direction.

13. A ground connection device for collectively connecting ground wires to first and second ground sections provided on a wall surface in a vehicle and spaced from one another along an arrangement direction, comprising:

a first ground connection fitting with a first wire connecting portion projecting transverse to the arrangement direction and shaped to be connectable to an end of at least one first ground wire and a first ground-side terminal portion defining a plate extending in the arrangement direction, the first ground-side terminal portion including a first ground section connection part connectable to the first ground section and a second ground section connection part connectable to the second ground section, the first and second ground section connection parts being formed respectively with first and second press-contact portions and first and second coupling portions;

a second connector housing laterally adjacent the first wire connecting portion and formed with a plurality of second terminal accommodating chambers arranged parallel to the arrangement direction with each of the second terminal accommodating chambers extending perpendicular to the arrangement direction and formed with a terminal lock, a plurality of second wire terminals to be mounted respectively on ends of a plurality of the ground wires and locked respectively in the second terminal accommodating chambers by the terminal locks;

a second ground connection fitting with a second ground-side terminal portion including a first ground section connection part that is pressed by the first press-contact portion into contact with the first coupling portion of the first ground-side terminal portion for simultaneous connection of the first ground section connection parts of the first and second ground connection fittings to the first ground section, a plurality of second wire-side terminal portions shaped to fit into the second terminal accommodating chambers and to mate with the respective second wire terminals in a common specific terminal fitting direction; and a third ground connection fitting with a third wire connecting portion shaped to be connectable to an end of at least one third ground wire at a lateral side of the first wire connecting portion opposite the second connector housing and a third ground-side terminal portion including a second ground section connection part that is pressed by the second press-contact portion into contact with the second coupling portion of the first ground-side terminal portion for simultaneous connection of the second ground section connection parts of the first and third ground connection fittings to the second ground section.

14. The ground connection device of claim 12, wherein:

the second ground-side terminal portion is so coupled to the first coupling portion as to be located below the first ground-side terminal portion; and the third ground-side terminal portion is so coupled to the second coupling portion as to be located above the first ground-side terminal portion.

15. The ground connection device of claim 14, wherein:

the second ground-side terminal portion is so coupled to the first coupling portion as to be located below the first ground-side terminal portion; and the third ground-side terminal portion is so coupled to the second coupling portion as to be located above the first ground-side terminal portion.

* * * * *